US011571793B2

(12) United States Patent
Ootsuka et al.

(10) Patent No.: US 11,571,793 B2
(45) Date of Patent: Feb. 7, 2023

(54) DRIVING TOOL

(71) Applicant: Koki Holdings Co., Ltd., Tokyo (JP)

(72) Inventors: Kazuhiro Ootsuka, Ibaraki (JP); Takuya Konnai, Ibaraki (JP)

(73) Assignee: Koki Holdings Co., Ltd., Tokyo (JP)

( * ) Notice: Subject to any disclaimer, the term of this patent is extended or adjusted under 35 U.S.C. 154(b) by 50 days.

(21) Appl. No.: 15/734,563

(22) PCT Filed: May 17, 2019

(86) PCT No.: PCT/JP2019/019699
§ 371 (c)(1),
(2) Date: Dec. 3, 2020

(87) PCT Pub. No.: WO2019/235178
PCT Pub. Date: Dec. 12, 2019

(65) Prior Publication Data

US 2021/0229249 A1 Jul. 29, 2021

(30) Foreign Application Priority Data

Jun. 5, 2018 (JP) ..... JP2018-107810

(51) Int. Cl.
*B25C 1/04* (2006.01)
*B25C 1/06* (2006.01)

(52) U.S. Cl.
CPC ..... *B25C 1/047* (2013.01); *B25C 1/043* (2013.01); *B25C 1/06* (2013.01)

(58) Field of Classification Search
CPC ... B25C 1/043–047; B25C 1/008; B24C 1/04; B24C 1/06
See application file for complete search history.

(56) References Cited

U.S. PATENT DOCUMENTS 9,205,545 B2 12/2015 Huang
2006/0261121 A1* 11/2006 Uchiyama ..... B25C 1/043 227/8

(Continued)

FOREIGN PATENT DOCUMENTS

JP 2012115922 6/2012
JP 2016179526 10/2016

OTHER PUBLICATIONS

"Search Report of Europe Counterpart Application", dated Jul. 13, 2021, pp. 1-9.

(Continued)

*Primary Examiner* — Anna K Kinsaul
*Assistant Examiner* — Veronica Martin
(74) *Attorney, Agent, or Firm* — JCIPRNET

(57) ABSTRACT

A driving tool includes a housing having a support shaft for operably supporting an operating member, a contacting member which is capable of contacting and separating from a workpiece into which a fastener is to be driven, and which operates by contacting the workpiece, a pressure chamber to which and from which a compressible gas is supplied and discharged, a striking part operating in a direction to strike the fastener, a gas supply mechanism, and a transmission control member for controlling the operation of the gas supply mechanism, said operation being based on the operation of at least one of the operating member and the contacting member or the operation of both of them, wherein the fastener is struck when an operating force is applied to the operating member and to the transmission control member, and the contacting member is operated.

12 Claims, 32 Drawing Sheets

(56) References Cited

U.S. PATENT DOCUMENTS

| | | | | |
|---|---|---|---|---|
| 2007/0075113 | A1* | 4/2007 | Tillinghast | B25C 1/043 227/130 |
| 2010/0012700 | A1* | 1/2010 | Perron | B25C 1/043 227/8 |
| 2013/0228606 | A1 | 9/2013 | Staples et al. | |
| 2015/0306752 | A1 | 10/2015 | Shen et al. | |
| 2018/0207777 | A1* | 7/2018 | Cheatham | B25C 1/008 |
| 2019/0344414 | A1* | 11/2019 | Lin | B25C 1/047 |

OTHER PUBLICATIONS

"International Search Report (Form PCT/ISA/210)" of PCT/JP2019/019699, dated Aug. 13, 2019, with English translation thereof, pp. 1-2.

* cited by examiner

DRIVING TOOL

CROSS-REFERENCE TO RELATED APPLICATION

This application is a 371 application of the International PCT application serial no. PCT/JP2019/019699, filed on May 17, 2019, which claims the priority benefits of Japan Patent Application No. 2018-107810, filed on Jun. 5, 2018. The entirety of each of the above-mentioned patent applications is hereby incorporated by reference herein and made a part of this specification.

BACKGROUND

Technical Field

The disclosure relates to a driving tool having a striking part which operates by the pressure of a compressible gas.

Description of Related Art

Patent Document 1 describes an example of a driving tool having a pressure chamber to which a compressible gas is supplied and a striking part which operates by the pressure of the compressible gas supplied to the pressure chamber. The driving tool described in Patent Document 1 has the striking part, a piston upper chamber, a main valve chamber, a cylinder, a pressure accumulating chamber, a switching knob, a trigger valve as a gas supply mechanism, a trigger as an operating member, and a push lever as a contacting member. In the driving tool described in Patent Document 1, when an operating force is applied to the trigger and the push lever is pressed against a workpiece, the trigger valve operates and the compressible gas in the pressure accumulating chamber is supplied to the main valve chamber. The cylinder operates by the pressure of the main valve chamber, and the compressible gas in the pressure accumulating chamber is supplied to the piston upper chamber, and the striking part operates from the top dead center toward the bottom dead center.

In the driving tool described in Patent Document 1, an operator can operate the switching knob to switch between a first mode and a second mode. After selecting the first mode, the operator applies the operating force to the trigger after pressing the push lever against the workpiece. After selecting the second mode, the operator performs an operation of pressing the push lever against the workpiece while applying the operating force to the trigger.

RELATED ART

Patent Document

[Patent Document 1] Japanese Laid-Open No. 2012-115922

SUMMARY

Technical Problem

The inventors of the present application have recognized that in the second mode, since the operating force is being applied to the trigger, driving may be performed at a position or angle slightly different from the intended driving position in the process of pressing the push lever against the workpiece.

The disclosure provides a driving tool that is provided with a function of restricting the transmission of the operating force of the contacting member to the gas supply mechanism and that allows an operator to actively release the restriction.

Solution to the Problem

A driving tool according to an embodiment includes: a housing including a support shaft that operably supports an operating member; a contacting member which is capable of contacting and separating from a workpiece into which a fastener is to be driven, and which operates by coming into contact with the workpiece; a pressure chamber to which and from which a compressible gas is supplied and discharged; a striking part which operates in a direction to strike the fastener when the compressible gas is supplied to the pressure chamber; and a gas supply mechanism which supplies the compressible gas to the pressure chamber based on an operation of the operating member and the contacting member, and a transmission control member is provided which controls an operation of the gas supply mechanism based on an operation of at least one of the operating member and the contacting member, or based on an operation of both of the operating member and the contacting member, and an operation of striking the fastener is performed when an operating force is applied to the operating member and the transmission control member and when the contacting member is operated. Further, other specific methods form a part or all of the configurations described in the following description of embodiments of the disclosure.

Effects

According to the driving tool of one embodiment, the operator controls the transmission of the operating force of the contacting member to the gas supply mechanism in association with the operating force applied to the operating member and the transmission control member by the operator.

DESCRIPTION OF THE EMBODIMENTS

Figure 1:
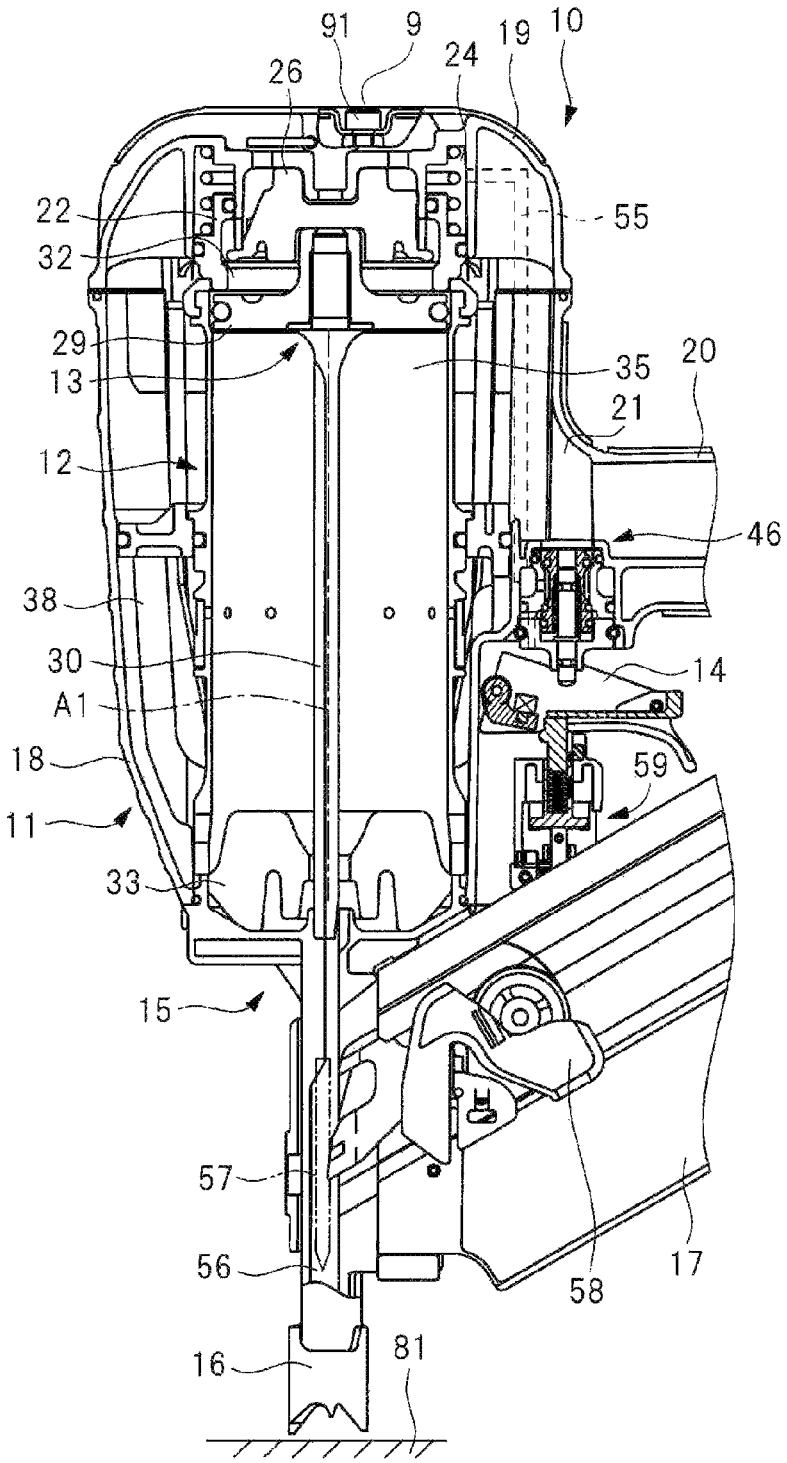
FIG. 1 is a longitudinal cross-sectional view showing a first embodiment of a driving tool.

Hereinafter, an exemplary driving tool among several embodiments included in the driving tool of the disclosure will be described with reference to the drawings.

(First embodiment) A first embodiment of a driving tool will be described with reference to FIGS. 1 and 2. A driving tool 10 has a main body 11, a cylinder 12, a striking part 13, a trigger 14, an ejector 15 and a push lever 16, and is provided with a transmission mechanism 59. Further, a magazine 17 is attached to the driving tool 10. The main body 11 has a tubular body part 18, a head cover 19 fixed to the body part 18, and a handle 20 connected to the body part 18. The handle 20 protrudes from the outer surface of the body part 18. A transmission control part 9 is preferably a switch 91 having electrical contacts, and is provided on the surface of the head cover 19 in a state where it can be operated by an operator.

Figure 2:
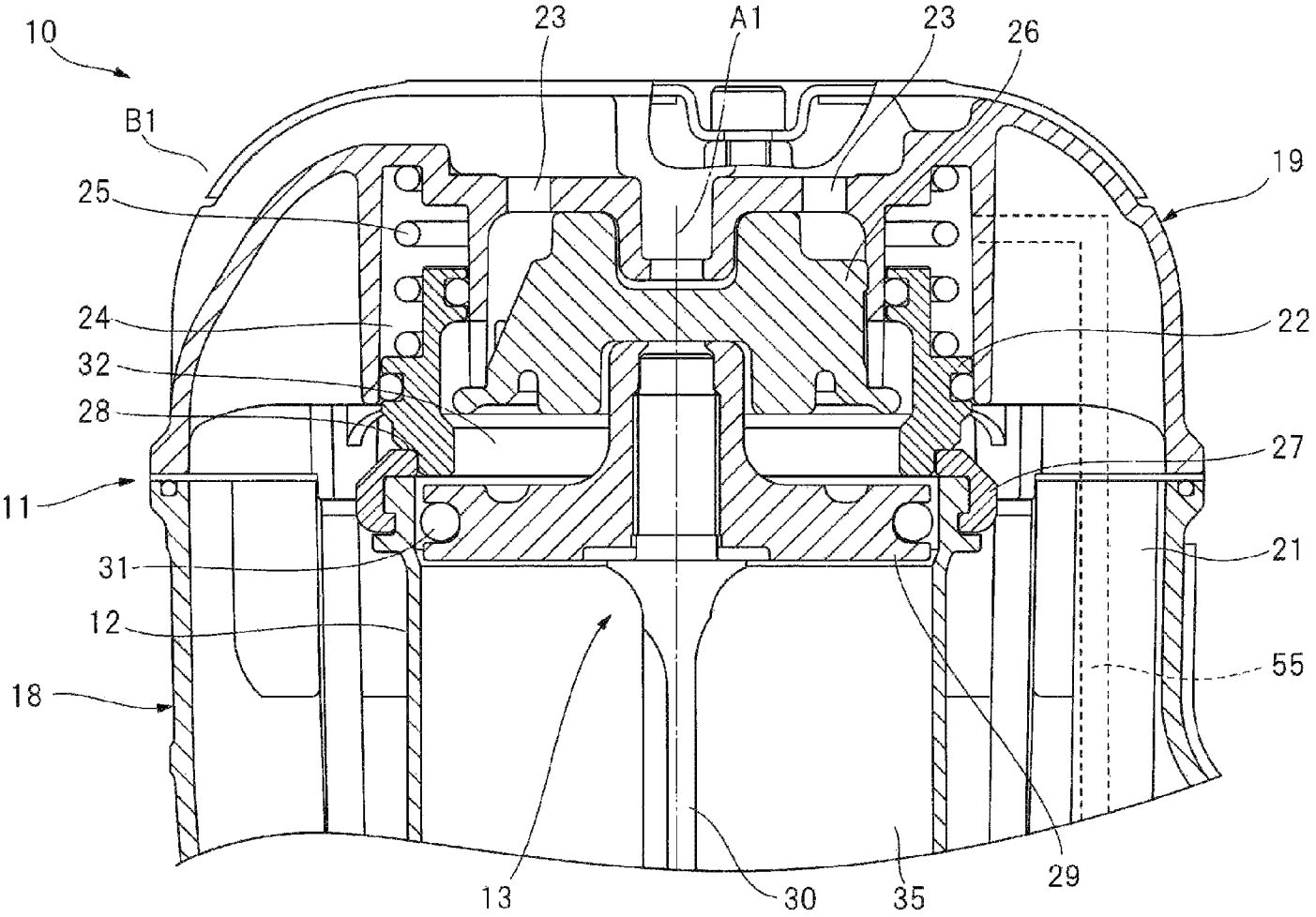
FIG. 2 is a cross-sectional view showing the inside of the head cover of the driving tool in FIG. 1.

As shown in FIGS. 1 and 2, a pressure accumulating chamber 21 is formed across the inside of the handle 20, the inside of the body part 18, and the inside of the head cover 19. A plug is attached to the handle 20, and an air hose is connected to the plug. Compressed air as a compressible gas is supplied into the pressure accumulating chamber 21 via the air hose. The cylinder 12 is provided in the body part 18.

A head valve 22 is provided inside the head cover 19. The head valve 22 has a cylindrical shape, and the head valve 22 is movable in the direction of a center line A1 of the cylinder 12. The head valve 22 has an exhaust passage 23. The exhaust passage 23 is connected to the outside B1 of the main body 11. A control chamber 24 is formed between the head cover 19 and the head valve 22. An urging member 25 is provided in the control chamber 24. The urging member 25 is, for example, a metal compression coil spring. A stopper 26 is attached to the head cover 19. The stopper 26 is, for example, made of synthetic rubber.

The cylinder 12 is positioned and fixed to the body part 18 in the direction of the center line A1. In the cylinder 12, a valve seat 27 is attached to an end of the cylinder 12 closest to the head valve 22 in the direction of the center line A1. The valve seat 27 has an annular shape and is made of synthetic rubber. A port 28 is formed between the head valve 22 and the valve seat 27.

The head valve 22 is urged by the urging force of the urging member 25 and the pressure of the control chamber 24 in a direction to approach the valve seat 27 in the direction of the center line A1. The head valve 22 is urged by the pressure in the pressure accumulating chamber 21 in a direction away from the valve seat 27. The head valve 22 closes the port 28 by pressing against the valve seat 27. The head valve 22 opens the port 28 by separating from the valve seat 27.

The striking part 13 has a piston 29 and a driver blade 30 fixed to the piston 29. The piston 29 is disposed in the cylinder 12, and the piston 29 is movable in the direction of the center line A1. A seal member 31 is attached to the outer circumferential surface of the piston 29. A piston upper chamber 32 is formed between the stopper 26 and the piston 29. When the head valve 22 opens the port 28, the compressed air in the pressure accumulating chamber 21 is connected to the piston upper chamber 32, and the head valve 22 disconnects the piston upper chamber 32 and the exhaust passage 23. When the head valve 22 closes the port 28, the pressure accumulating chamber 21 is disconnected from the piston upper chamber 32, and the piston upper chamber 32 and the exhaust passage 23 are connected.

The ejector 15 is fixed to the body part 18 at the end opposite to the part where the head cover 19 is provided in the direction of the center line A1.

Figure 3:
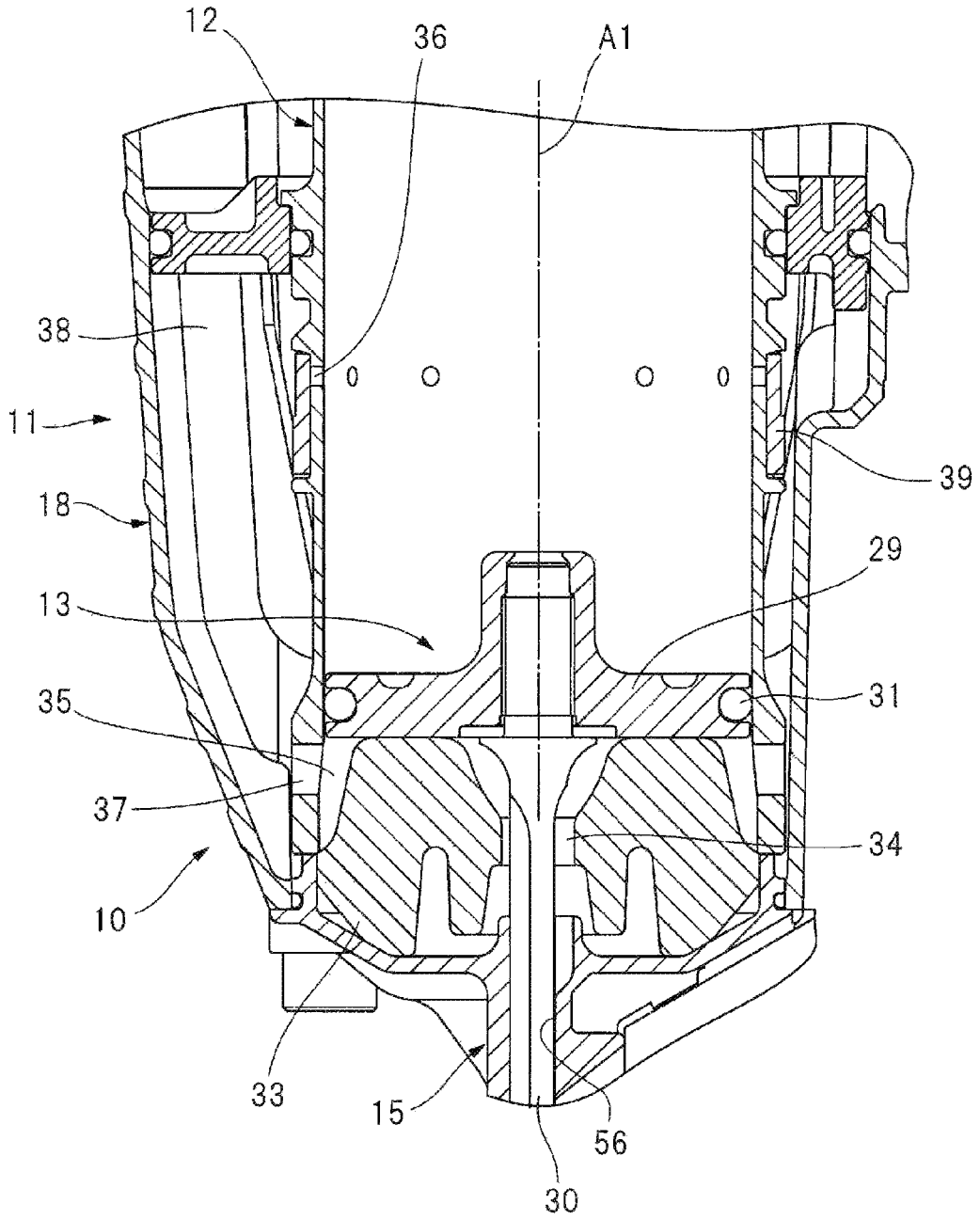
FIG. 3 is a cross-sectional view showing the inside of the cylinder of the driving tool of FIG. 1.

As shown in FIGS. 1 and 3, a bumper 33 is provided inside the cylinder 12. The bumper 33 is disposed in the cylinder 12 at a position closest to the ejector 15 in the direction of the center line A1. The bumper 33 is made of synthetic rubber or silicon rubber. The bumper 33 has a shaft hole 34, and the driver blade 30 is movable in the shaft hole 34 in the direction of the center line A1. In the cylinder 12, a piston lower chamber 35 is formed between the piston 29 and the bumper 33. The seal member 31 hermetically disconnects the piston lower chamber 35 and the piston upper chamber 32.

Passages 36 and 37 are provided to penetrate the cylinder 12 in the radial direction. The passage 37 is disposed between the passage 36 and the ejector 15 in the direction of the center line A1. A return air chamber 38 is formed between the outer surface of the cylinder 12 and the body part 18. A check valve 39 is provided in the cylinder 12. Compressed air is enclosed in the piston lower chamber 35 and the return air chamber 38.

Figure 4:
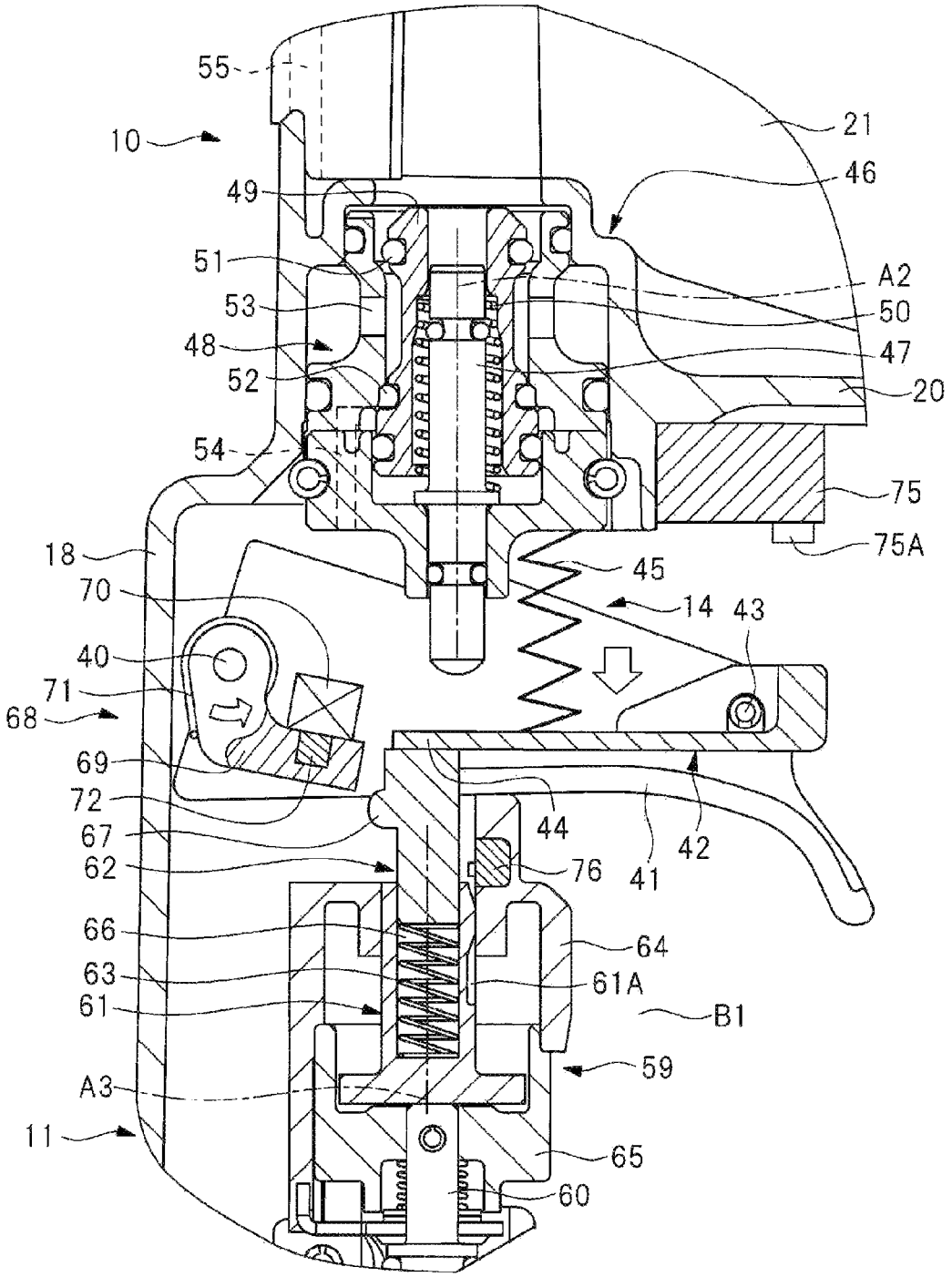
FIG. 4 is a cross-sectional view of the trigger and the restricting mechanism provided in the driving tool of FIG. 1, the trigger and the restricting mechanism being in the initial state.

As shown in FIGS. 1 and 4, the trigger 14 is attached to the main body 11. The trigger 14 is attached to the main body 11 via a support shaft 40. The trigger 14 is operable, that is, rotatable about the support shaft 40 within a range of a predetermined angle. The trigger 14 has a stopper 41. The operator grasps the handle 20 with one hand and applies or releases the operating force to the trigger 14 with a finger. When the operator applies the operating force to the trigger 14, the trigger 14 operates in the counterclockwise direction in FIG. 4.

A trigger arm 42 is attached to the trigger 14. The trigger arm 42 is operable with respect to the trigger 14 about a support shaft 43 within a range of a predetermined angle. A free end 44 of the trigger arm 42 is located between the support shaft 40 and the support shaft 43 in the length direction of the trigger 14. The trigger arm 42 is provided with an urging member 45 which urges with the support shaft 43 as a center. The urging member 45 is, for example, a metal spring. The urging member 45 urges the trigger arm 42 in the counterclockwise direction in FIG. 4. A part of the urging force applied to the trigger arm 42 is transmitted to the trigger 14. The trigger 14 is urged in the clockwise direction in FIG. 4 by the urging member 45.

As shown in FIGS. 1 and 4, a trigger valve 46 is provided at the connection part between the body part 18 and the handle 20. The trigger valve 46 has a plunger 47, a body 48, a valve body 49, an urging member 50, seal members 51 and 52 provided on the valve body 49, a passage 53 provided on the body 48, and an exhaust passage 54. The exhaust passage 54 is connected to the outside B1. A passage 55 is provided in the main body 11, and the passage 53 is connected to the control chamber 24 via the passage 55.

The plunger 47 is movable in the direction of a center line A2, and the valve body 49 moves and stops in the direction of the center line A2 according to the position of the plunger 47 in the direction of the center line A2. Depending on the position of the valve body 49 in the direction of the center line A2, the seal members 51 and 52 contact or separate from the body 48, respectively. When the seal member 51 separates from the body 48, the pressure accumulating chamber 21 and the passage 53 are connected, and the seal member 52 contacts the body 48, and the passage 53 and the exhaust passage 54 are disconnected. When the seal member 51 contacts the body 48, the pressure accumulating chamber 21 and the passage 53 are disconnected, and the seal member 52 separates from the body 48, and the passage 53 and the exhaust passage 54 are connected.

The ejector 15 shown in FIG. 1 is, for example, made of metal or non-ferrous metal. The ejector 15 has an ejection path 56. The center line A1 is located in the ejection path 56, and the driver blade 30 is movable in the ejection path 56 in the direction of the center line A1.

The magazine 17 is fixed to the ejector 15. The magazine 17 houses nails 57. The magazine 17 has a feeder 58, and the feeder 58 sends the nails 57 in the magazine 17 to the ejection path 56.

The push lever 16 is attached to the ejector 15. The push lever 16 is operable with respect to the ejector 15 within a predetermined range in the direction of the center line A1. FIG. 4 shows an enlarged view of the transmission mechanism 59. The transmission mechanism 59 transmits the operating force of the push lever 16 to the plunger 47. The transmission mechanism 59 has a plunger 60, a cylinder 61, a pin 62, and an urging member 63. The plunger 60, the cylinder 61, and the pin 62 are made of metal. Further, the main body 11 is provided with a holder 64 and an adjuster 65. The holder 64 has a tubular shape, and the holder 64 and the adjuster 65 operably support the cylinder 61. The plunger 60, the cylinder 61 and the pin 62 are operable in the direction of a center line A3. The center line A2 and the center line A3 are parallel to each other. Further, the center line A2 and the center line A3 may be coaxially disposed.

The push lever 16 and the plunger 60 are connected to be able to transmit the operating force. The plunger 60 and the cylinder 61 are connected to be able to transmit the operating force. The cylinder 61 has a support hole 66, and the urging member 63 is disposed in the support hole 66. A part of the pin 62 in the direction of the center line A3 is disposed in the support hole 66, and a part of the pin 62 in the direction of the center line A3 is disposed outside the support hole 66. The urging member 63 is, for example, a metal compression spring. The urging member 63 urges the pin 62 in a direction to approach the trigger valve 46 in the direction of the center line A3. The spring constant of the urging member 63 is larger than the spring constant of the urging member 50. A recess 61A is provided on the outer circumferential surface of the cylinder 61. An engaging part 67 is provided on the outer surface of the pin 62 on the part where the pin 62 is outside the support hole 66. The outer surface of the engaging part 67 has an arc shape. The free end 44 of the trigger arm 42 is disposed between the plunger 47 and the pin 62 in the direction of the center line A3.

A restricting mechanism 68 shown in FIG. 4 is provided. The restricting mechanism 68 shown in FIG. 4 is, for example, provided in the trigger 14. The restricting mechanism 68 has a function of preventing the operating force of the pin 62 from being transmitted to the plunger 47. The restricting mechanism 68 has a stopper 69, an electromagnet 70, and an urging member 71. The stopper 69 is made of synthetic resin or metal, and the stopper 69 is supported by the support shaft 40. The stopper 69 is operable (that is, rotatable) within a range of a predetermined angle with respect to the trigger 14 about the support shaft 40. A permanent magnet 72 is attached to the stopper 69. The urging member 71 is, for example, a metal torsion coil spring. The urging member 71 urges the stopper 69 in the counterclockwise direction in FIG. 4.

The electromagnet 70 has a magnetic material and a conductive coil. The electromagnet 70 generates a magnetic force when a current passes through the coil, and the magnetic force disappears when the current does not pass through the coil. The direction of the current passing through the coil is set so that the magnetic force generated by the electromagnet 70 repels the magnetic force of the permanent magnet 72. That is, the polarity of the electromagnet 70 is the same as the polarity of the permanent magnet 72. The electromagnet 70 is disposed within the operating range of the stopper 69. When no current flows in the electromagnet 70, the stopper 69 urged by the urging member 71 is pressed by the electromagnet 70 and stops at the initial position. When power is supplied to the electromagnet 70 and the electromagnet 70 generates a magnetic force, the stopper 69 operates in the clockwise direction in FIG. 4 against the urging force of the urging member 71 and stops at a position away from the electromagnet 70.

Figure 5:
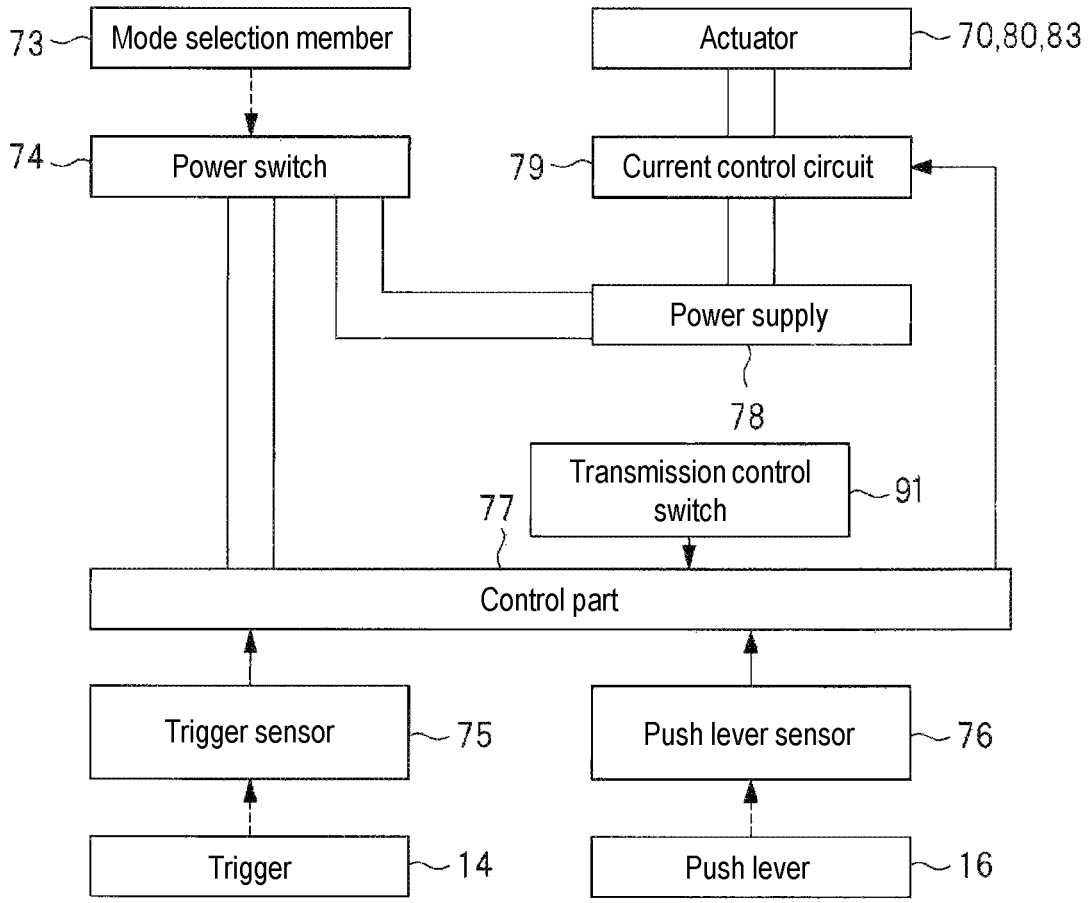
FIG. 5 is a block diagram showing the control system of the driving tool of FIG. 1.

FIG. 5 is a block diagram showing the control system of the driving tool 10. The driving tool 10 includes a mode selection member 73, a power switch 74, a trigger sensor 75, a push lever sensor 76, a control part 77, a power supply 78, a current control circuit 79, an actuator 80, and a transmission control switch 91. The current control circuit 79 is provided between the power supply 78 and the actuator 80. For example, a battery pack may be used as the power supply 78. The battery pack has a case and a battery housed inside the case. The battery pack is attachable to and removable from the outer surface of the main body 11 or the outer surface of the magazine 17.

The mode selection member 73 is provided on the main body 11. The mode selection member 73 is, for example, a lever that is operable within a range of a predetermined angle. The mode selection member 73 has a first operating position corresponding to a first mode and a second operating position corresponding to a second mode. In the first mode, the operator applies an operating force to the trigger 14 in a state where the push lever 16 shown in FIG. 1 is in contact with a workpiece 81. In the second mode, the push lever 16 is brought into contact with the workpiece 81 in a state where the operator has applied an operating force to the trigger 14. The operator operates the mode selection member 73 to select the first mode or the second mode in a state where the operating force applied to the trigger 14 is released and the push lever 16 separates from the workpiece 81.

The power switch 74 disconnects the power supply 78 and the control part 77 when the mode selection member 73 is in the first operating position, and connects the power supply 78 and the control part 77 when the mode selection member 73 is in the second operating position. The power switch 74 is a contact switch and is, for example, a tactile switch. The current control circuit 79 has, for example, multiple field effect transistors.

The trigger sensor 75 outputs a signal according to the presence/absence of an operating force on the trigger 14 and the operating state of the push lever 16. For example, a contact sensor may be used as the trigger sensor 75. The trigger 14 is operable between an initial position and an operating position. The initial position of the trigger 14 is a position where a part of the trigger 14 contacts the holder 64 and stops as shown in FIG. 4. Further, it is also possible to define as the initial position the position where the trigger arm 42 contacts the pin 62 by the force of the urging member 45 and the trigger 14 stops. The operating position of the trigger 14 is a position where the trigger 14 stops because a part of the trigger 14 contacts the body 48 or the main body 11. The trigger sensor 75 has a contactor 75A. When an object is pressed against the contactor 75A, the trigger sensor 75 turns on, and when the force with which the object presses the contactor 75A decreases or the object separates, the trigger sensor 75 turns off. In the embodiment, the trigger sensor 75 turns on or off in the following cases.

Figure 7:
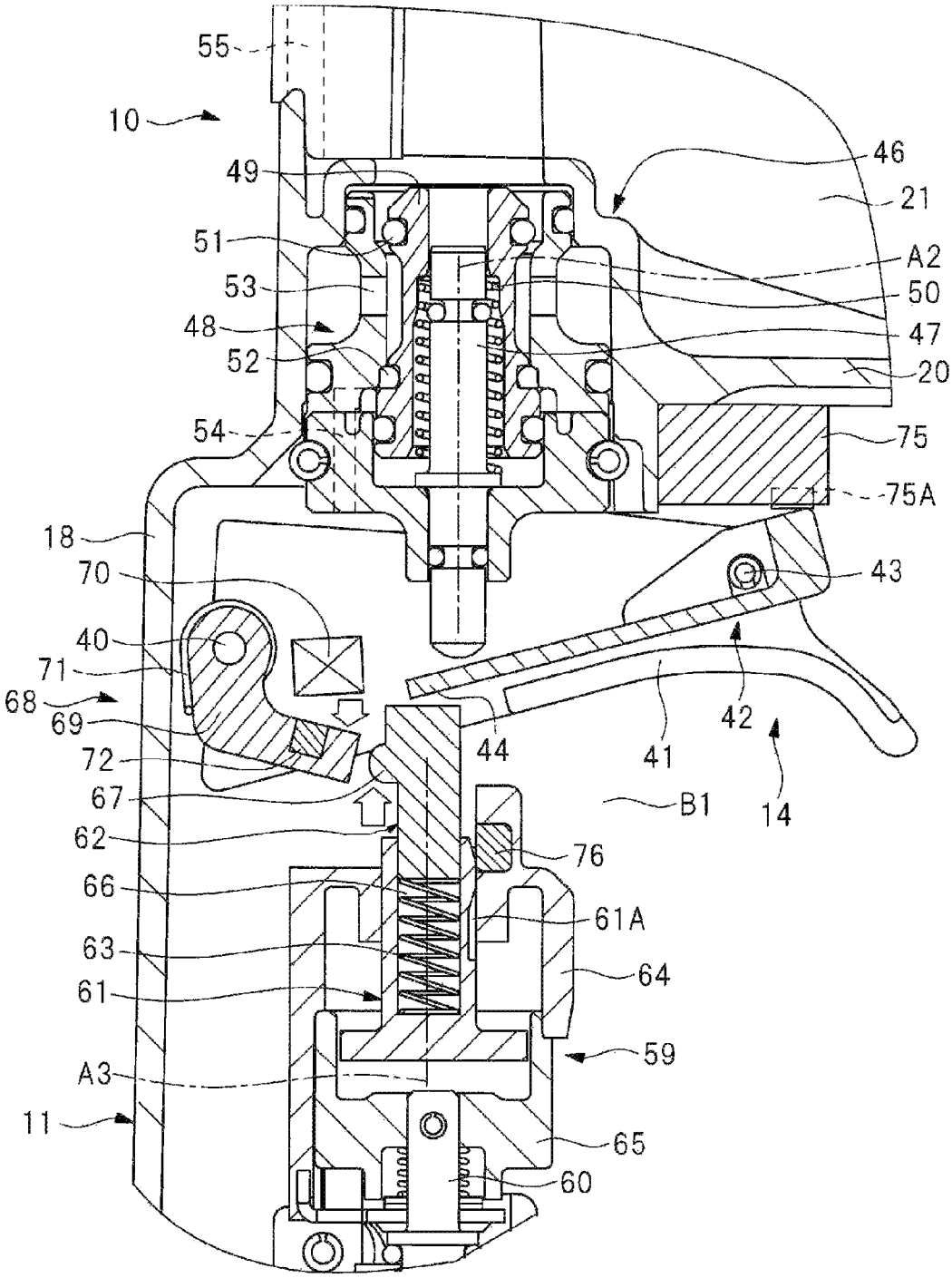
FIG. 7 is a cross-sectional view in which the trigger is in the operating state and the restricting mechanism is in the operating state.

When the trigger 14 stops at the initial position as shown in FIG. 4, the trigger sensor 75 turns off regardless of the position of the push lever 16. Further, the trigger sensor 75 turns on in a state where the operating force is applied to the trigger 14 to stop it in the operating position as shown in FIG. 7 and the push lever 16 separates from the workpiece 81. The trigger 14 stopping at the operating position does not contact the trigger sensor 75, and when a part of the trigger arm 42 presses the contactor 75A, the trigger sensor 75 turns on.

Figure 8:
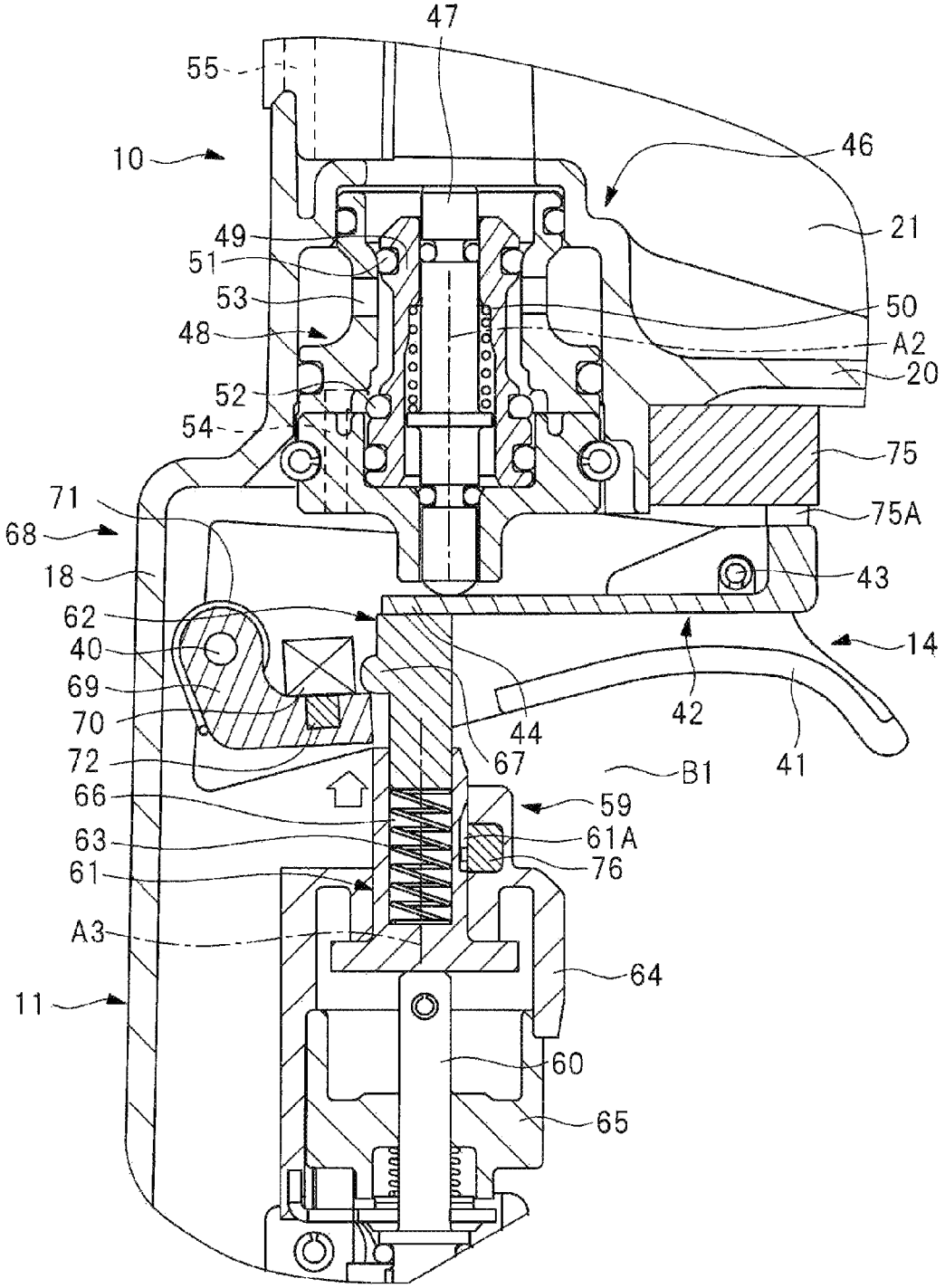
FIG. 8 is a cross-sectional view in which the trigger is in the operating state, the restricting mechanism is in the initial state, and the trigger valve is in the operating state.

As shown in FIG. 7, when the trigger sensor 75 turns on, the push lever 16 is pressed against the workpiece 81 and the pin 62 operates from the initial position, and when the pin 62 reaches the operating position shown in FIG. 8, the trigger sensor 75 turns off. This is because the trigger arm 42 pressed by the pin 62 operates in the clockwise direction, and the force with which the trigger arm 42 presses the contactor 75A decreases. In this way, the trigger sensor 75 can turn on or off in a state where the trigger 14 stops at the operating position. The trigger sensor 75 shown in FIG. 4 is, for example, provided on the outer surface of the handle 20.

The push lever sensor 76 outputs a signal according to the push lever 16 being at the initial position or the operating position and a signal according to the push lever 16 passing through an intermediate position between the initial position and the operating position. For the push lever sensor 76, an example using a contact sensor that does not directly detect the plunger operation of the push lever 16 but outputs a signal according to the position of the cylinder 61 in the direction of the center line A3 will be disclosed. When the push lever 16 is at the initial position, that is, when the push lever 16 separates from the workpiece 81, the push lever sensor 76 turns off.

The push lever sensor 76 turns on when the push lever 16 is at the intermediate position between the initial position and the operating position and contacts the pin 62. The push lever sensor 76 turns off when the push lever 16 reaches the operating position. Specifically, the push lever sensor 76 separates from the cylinder 61 and turns off at a position corresponding to the recess 61A. The signals from the trigger sensor 75 and the push lever sensor 76 are input to the control part 77.

The transmission control switch 91 that configures the transmission control part 9 is exposed on the surface of the head cover 19 shown in FIG. 1, and turns on when the transmission control switch 91 is pressed. Specifically, in a state where the operator holds the handle 20 with one hand and presses toward the head cover 19 with the other hand, the ON signal is input to the control part 77.

The control part 77 is a microcomputer that optionally has an input interface, an output interface, a storage unit, an arithmetic processing unit, a timer, and the like. The control part 77 is activated when the power switch 74 turns on, and stops when the power switch 74 turns off. The actuator 80 includes the electromagnet 70. The control part 77 controls connection and disconnection of the current control circuit 79 and also controls the direction of current to the electromagnet 70.

When the push lever 16 separates from the workpiece 81 and the trigger sensor 75 turns on, the control part 77 determines that the operating force is applied to the trigger 14. When the push lever sensor 76 is switched from off to on, the control part 77 determines that the push lever 16 is pressed against the workpiece 81 to operate. When the push lever sensor 76 is switched from on to off, the control part 77 determines that the push lever 16 has reached the initial position after operating. Further, when the transmission control switch 91 is switched from off to on, the control part 77 determines that the operating force is applied to the transmission control switch.

(Usage Example of Driving tool) Next, a usage example of the driving tool 10 will be described. When the operator releases the operating force on the trigger 14, the push lever 16 separates from the workpiece 81, and the transmission control switch 91 is released; then, the trigger 14 is pressed against the holder 64, or the free end 44 of the trigger arm 42 is pressed against the tip of the pin 62, and the trigger 14 and the trigger arm 42 stop at the initial positions.

When the operating force on the trigger 14 is released, the push lever 16 separates from the workpiece 81, and the transmission control switch 91 is released; then, the trigger valve 46, the head valve 22, and the striking part 13 are in the initial state as described below.

When the trigger valve 46 is in the initial state, the pressure accumulating chamber 21 and the passage 53 are connected, and the passage 53 and the exhaust passage 54 are disconnected. Therefore, the compressed air in the pressure accumulating chamber 21 is supplied to the control chamber 24, and the head valve 22 closes the port 28. That is, the head valve 22 disconnects the pressure accumulating chamber 21 and the piston upper chamber 32. Further, the head valve 22 connects the piston upper chamber 32 and the exhaust passage 23, and the piston upper chamber 32 is connected to the outside B1 via the exhaust passage 23. Therefore, the pressure in the piston upper chamber 32 is the same as the atmospheric pressure and lower than the pressure in the piston lower chamber 35. Therefore, the piston 29 stops in a state of being pressed against the stopper 26 by the pressure of the piston lower chamber 35. In this way, the striking part 13 stops at the top dead center shown in FIGS. 1 and 2.

The operator operates the mode selection member 73 to select the first mode or the second mode in a state where the operating force applied to the trigger 14 is released and the push lever 16 separates from the workpiece 81. The first mode is a mode in which an operating force is applied to the trigger 14 in a state where the push lever 16 is in contact with the workpiece 81, and the second mode is a mode in which the push lever 16 is brought into contact with the workpiece 81 in a state where an operating force is applied to the trigger 14.

(Example of selecting the first mode) When the operator selects the first mode, the power switch 74 turns off. That is, the power of the power supply 78 is not supplied to the control part 77, and the control part 77 stops. In addition, the power is not supplied to the electromagnet 70. Therefore, the stopper 69 stops at the initial position where it comes into contact with the electromagnet 70. When the trigger 14 stops at the initial position and the electromagnet 70 is not supplied with power, the stopper 69 that stops at the initial position is located outside the operating range of the pin 62, particularly outside the operating range of the engaging part 67. Further, since the power switch 74 is off, the control part 77 remains stopped and is not influenced by the operation of the transmission control switch 91.

Then, the push lever 16 is pressed against the workpiece 81 in a state where the operator releases the operating force on the trigger 14. The push lever 16 operates in a direction to approach the bumper 33 by the reaction force of pressing the push lever 16 against the workpiece 81. The operating force of the push lever 16 is transmitted to the pin 62 via the plunger 60, the urging member 63 and the cylinder 61. The pin 62 operates in a direction to approach the plunger 47 in the direction of the center line A3. The stopper 69 is located outside the operating range of the engaging part 67 and does not block the operation of the pin 62. The operating force of the pin 62 is transmitted to the trigger arm 42, and the trigger arm 42 operates in the counterclockwise direction in FIG. 4. When the pin 62 stops, the trigger arm 42 also stops. At this time, the operating force of the trigger arm 42 is not transmitted to the plunger 47, and the trigger valve 46 is in the initial state.

When the operator applies an operating force to the trigger 14 in a state where the push lever 16 is pressed against the workpiece 81, the trigger 14 operates in the counterclockwise direction in FIG. 4 about the support shaft 40. Then, the trigger arm 42 operates together with the trigger 14. When the trigger 14 is pressed against the trigger sensor 75 and stops at the operating position, the trigger arm 42 also stops. When the trigger 14 operates in the counterclockwise direction and stops at the operating position, the engaging part 67 of the pin 62 is located between the tip of the stopper 69 and the free end 44 of the trigger arm 42 in the direction of the center line A3.

In this way, the operating force of the trigger arm 42 is transmitted to the plunger 47 during the process in which the trigger 14 operates in the counterclockwise direction. The plunger 47 operates from the initial position against the urging force of the urging member 50, and the trigger valve 46 turns to the operating state. In this way, the trigger arm 42 cooperates with the trigger 14 to transmit the operating force to the plunger 47.

When the trigger valve 46 turns to the operating state, the pressure accumulating chamber 21 and the passage 53 are disconnected, and the passage 53 and the exhaust passage 54 are connected. Therefore, the compressed air in the control chamber 24 is discharged to the outside B1 via the passage 55, the passage 53, and the exhaust passage 54, and the pressure in the control chamber 24 becomes the same as the atmospheric pressure.

When the pressure in the control chamber 24 becomes the same as the atmospheric pressure, the head valve 22 operates against the urging force of the urging member 25 by the pressure in the pressure accumulating chamber 21. Therefore, the head valve 22 disconnects the piston upper chamber 32 and the exhaust passage 23, and opens the port 28. That is, the pressure accumulating chamber 21 and the piston upper chamber 32 are connected, and the pressure in the piston upper chamber 32 increases. When the pressure in the piston upper chamber 32 becomes higher than the pressure in the piston lower chamber 35, the striking part 13 operates in the direction of the center line A1 from the top dead center to the bottom dead center, and the driver blade 30 strikes the nail 57 of the ejection path 56. The struck nail 57 is driven into the workpiece 81.

After the striking part 13 drives the nail 57 into the workpiece 81, the piston 29 collides with the bumper 33, and the bumper 33 absorbs a part of the kinetic energy of the striking part 13, as shown in FIG. 3. The position of the striking part 13 at the time when the piston 29 collides with the bumper 33 is the bottom dead center. Further, while the striking part 13 is operating from the top dead center to the bottom dead center, the check valve 39 opens the passage 36, and the compressed air in the piston lower chamber 35 flows into the return air chamber 38 from the passage 36.

After the striking part 13 strikes the nail 57, the operator separates the push lever 16 from the workpiece 81 and releases the operating force on the trigger 14. Then, the pin 62 operates in a direction away from the plunger 47 by the urging force of the urging member 45. Then, in a state where the engaging part 67 is in contact with the tip of the stopper 69 and the stopper 69 is pressed against the electromagnet 70, the pin 62 operates, or the stopper 69 operates in the clockwise direction against the urging force of the urging member 71; and in a state where the stopper 69 separates from the electromagnet 70, the pin 62 operates, and the pin 62 and the stopper 69 stop at the initial position shown in FIG. 4.

Further, the trigger valve 46 returns from the operating state to the initial state, and the head valve 22 closes the port 28 and connects the piston upper chamber 32 and the exhaust passage 23. Then, the pressure in the piston upper chamber 32 becomes the same as the atmospheric pressure, and the piston 29 operates from the bottom dead center to the top dead center by the pressure in the piston lower chamber 35. Further, the compressed air in the return air chamber 38 flows into the piston lower chamber 35 via the passage 37, and the striking part 13 returns to the top dead center and stops.

Figure 6:
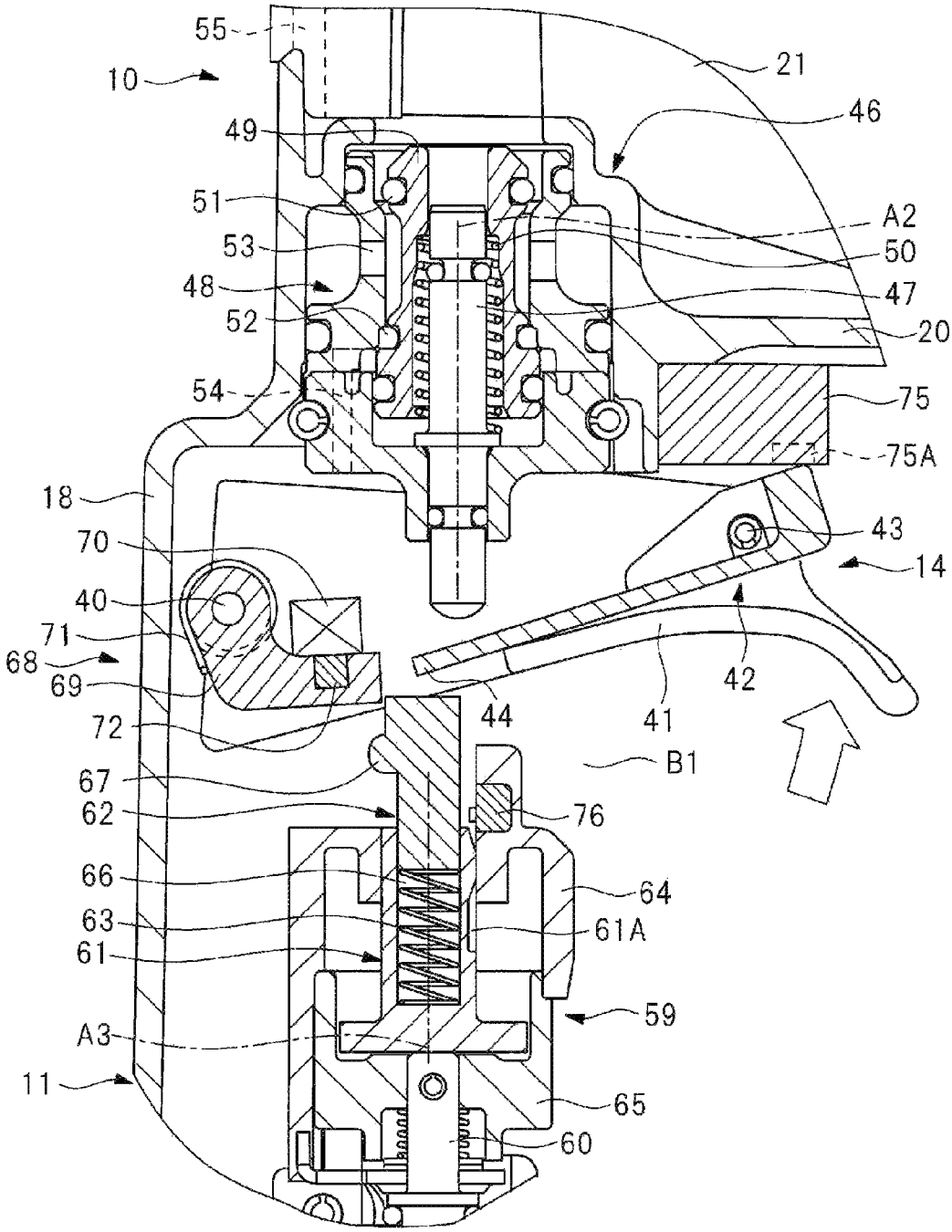
FIG. 6 is a cross-sectional view in which the trigger is in the operating state and the restricting mechanism is in the initial state.

(Example of selecting the second mode) When the operator operates the mode selection member 73 to select the second mode, the power switch 74 turns on, and the control part 77 is activated. In a state where the trigger 14 stops at the initial position and the pin 62 stops at the initial position as shown in FIG. 4, the operator applies an operating force to the trigger 14 while keeping the push lever 16 separated from the workpiece 81, operates the trigger 14 in the counterclockwise direction in FIG. 4, and stops the trigger 14 at the operating position. Then, the stopper 69 operates together with the trigger 14 in the counterclockwise direction in FIG. 4, and stops together with the trigger 14 at the operating position shown in FIG. 6. When the stopper 69 stops at the operating position, the tip of the stopper 69 is located within the operating range of the engaging part 67. Further, the trigger arm 42 separates from the pin 62, contacts the stopper 41, and stops.

In addition, when the control part 77 detects from the signal of the trigger sensor 75 that the operating force is applied to the trigger 14 and also detects that the transmission control switch 91 is switched from off to on, the control part 77 supplies power to the electromagnet 70. When a magnetic force is generated in the electromagnet 70, the stopper 69 operates in the clockwise direction as shown in FIG. 7 against the urging force of the urging member 71, and the tip of the stopper 69 stops outside the operating range of the engaging part 67.

Then, when the transmission control switch 91 is in the on state, that is, in a state where the tip of the stopper 69 stops outside the operating range of the engaging part 67, when the push lever 16 is pressed against the workpiece 81, the push lever sensor 76 turns on. Further, the cylinder 61 and the pin 62 operate in a direction to approach the plunger 47 from the initial position, and the cylinder 61 and the pin 62 stop at the operating positions. When the cylinder 61 reaches the operating position, the push lever sensor 76 turns off, and the control part 77 stops the supply of power to the electromagnet 70. Therefore, the stopper 69 returns to the initial position and stops.

The operating force of the pin 62 is transmitted to the plunger 47 via the trigger arm 42. Therefore, the trigger valve 46 switches from the initial state shown in FIG. 7 to the operating state shown in FIG. 8. Therefore, the striking part 13 operates from the top dead center toward the bottom dead center, and the striking part 13 drives the nail 57 into the workpiece 81.

On the contrary, when the transmission control switch 91 is in the off state before the push lever 16 is pressed against the workpiece 81, the control part 77 stops the supply of power to the electromagnet 70. That is, the stopper 69 stops at the initial position shown in FIG. 6. When the trigger 14 is at the operating position and the stopper 69 stops at the initial position, the tip of the stopper 69 is located within the operating range of the engaging part 67.

Therefore, when the push lever 16 is pressed against the workpiece 81 when the transmission control switch 91 is not operated, the tip of the stopper 69 engages with the engaging part 67. That is, the stopper 69 prevents the operating force of the push lever 16 from being transmitted to the plunger 47. Therefore, the trigger valve 46 is maintained in the initial state, and the striking part 13 stops at the initial position.

In this way, the stopper 69 can prevent the operating force of the push lever 16 from being transmitted to the trigger valve 46 in association with the operator applying the operating force to the trigger 14. Further, the power is supplied to the electromagnet 70 only when the operating force is applied to the trigger 14 and the operating force is applied to the transmission control switch 91. Therefore, the power consumption of the power supply 78 can be reduced as much as possible. Further, when the operator selects the first mode, the power is not supplied to the control part 77, and when the operator selects the second mode, the power is supplied to the control part 77. Therefore, the power consumption of the power supply 78 can be reduced.

Furthermore, when power cannot be supplied from the power supply 78 to the electromagnet 70, for example, when the voltage of the power supply 78 drops, by selecting the first mode, the driving can be performed without the operation of the electromagnet 70, and it is not necessary to operate the transmission control switch 91. That is, when the push lever 16 is pressed against the workpiece 81, the stopper 69 does not block the operation of the pin 62, and the pin 62 can move from the initial position to the operating position. By operating the trigger 14 in that state, the operating force is transmitted to the trigger valve 46, and the striking part 13 can be operated from the top dead center toward the bottom dead center.

Further, the urging member 63 is provided between the cylinder 61 and the pin 62. When a metal spring is used as the urging member 63, if the force with which the engaging part 67 is pressed against the stopper 69 is excessive, the spring elastically deforms, whereby the load received by the stopper 69 can be reduced. Therefore, the load on the restricting mechanism 68 can be reduced.

Figure 9:
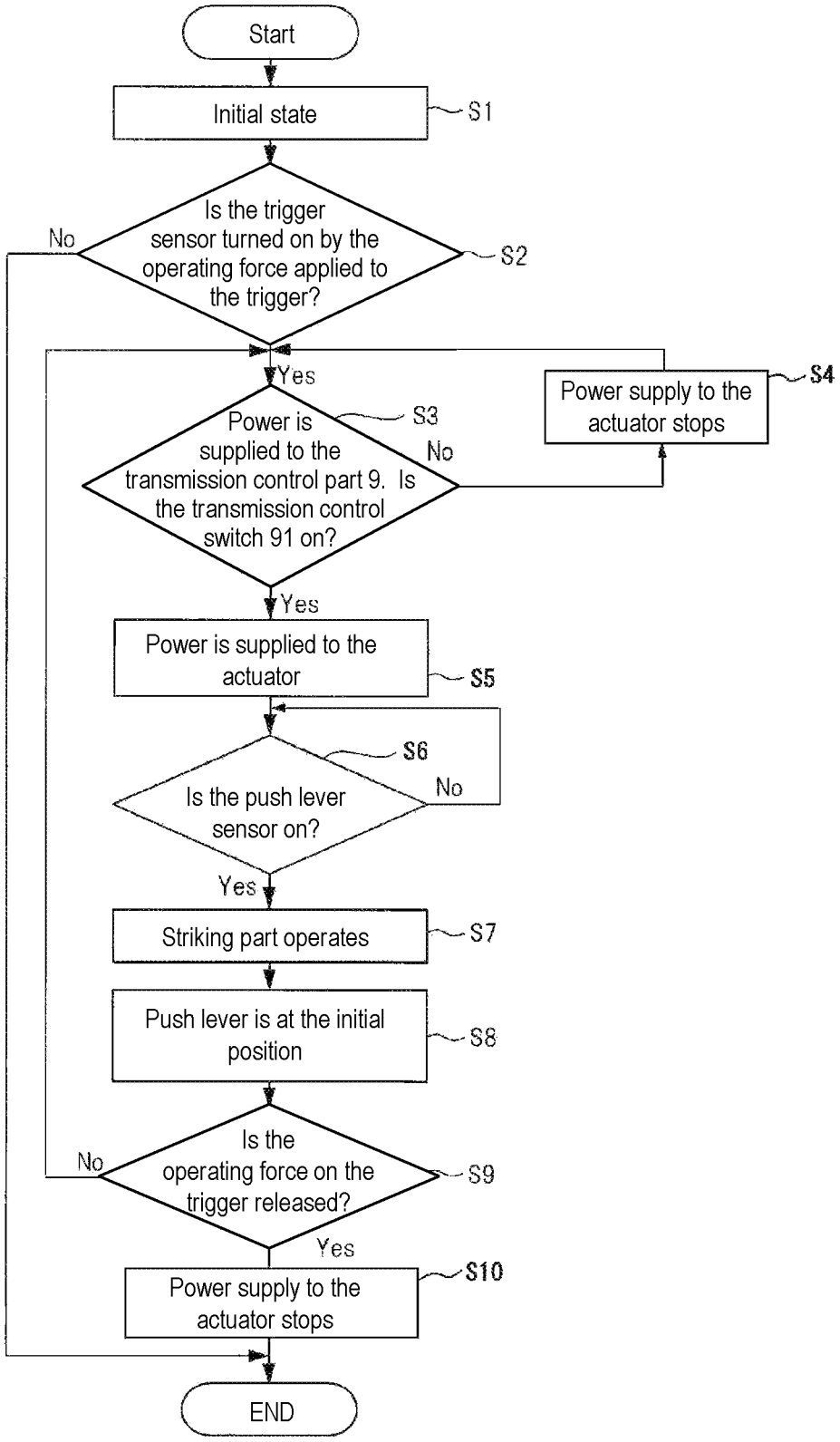
FIG. 9 is a flowchart showing a first control example that can be performed by the control part provided in the driving tool.

(First Control Example) FIG. 9 is a flowchart showing a first control example that can be performed by the control part 77. Further, FIG. 9 also includes matters in addition to the operation performed by the operator and the control performed by the control part 77. In step S1, the driving tool 10 is in the initial state. The initial state of the driving tool 10 means that the operating force on the trigger 14 is released, and the push lever 16 separates from the workpiece 81, and the power supply to the actuator 80 (that is, the electromagnet 70) stops.

In step S2, the control part 77 determines whether the trigger sensor 75 is turned on by the operating force applied to the trigger 14. As shown in FIG. 7, the trigger sensor 75 turns on when the trigger arm 42 that operates in the counterclockwise direction with the pin 62 as a fulcrum presses the contactor 75A.

When the control part 77 determines No in step S2, it ends the first control example of FIG. 9. When the control part 77 determines Yes in step S2, in step S3, it supplies power to the transmission control part 9 and determines whether the transmission control switch 91 is on. When the control part 77 determines in step S3 that the transmission control switch 91 is off, in step S4, it stops the power supply to the actuator if the power has been supplied to the actuator, and waits until the transmission control switch 91 is turned on.

In step S5, the control part 77 supplies power to the actuator if the power is not supplied to the actuator, and in step S6 determines whether the push lever sensor 76 is on. When the control part 77 determines Yes in step S6, it determines that the push lever 16 has reached the operating position.

In this way, when the push lever 16 is pressed against the workpiece 81 in a state where the operating force is applied to the trigger 14 and the transmission control switch 91 is operated, the trigger valve 46 switches from the initial state to the operating state, and in step S7, the striking part 13 operates from the top dead center toward the bottom dead center.

The operator separates the push lever 16 from the workpiece 81 after the striking part 13 operates from the top dead center toward the bottom dead center. The control part 77 detects in step S8 that the push lever 16 has been returned to the initial position. In addition, the control part 77 determines in step S9 whether the operating force on the trigger 14 has been released. When the push lever 16 stops at the initial position and the trigger sensor 75 is off, the control part 77 determines that the operating force on the trigger 14 has been released. When the control part 77 determines No in step S9, it means that the operator intends to continue the driving operation in the second mode; therefore, the control part 77 returns to step S3.

On the contrary, when the control part 77 determines Yes in step S9, the power supply to the actuator stops in step S10, and then the first control example of FIG. 9 ends.

Figure 10:
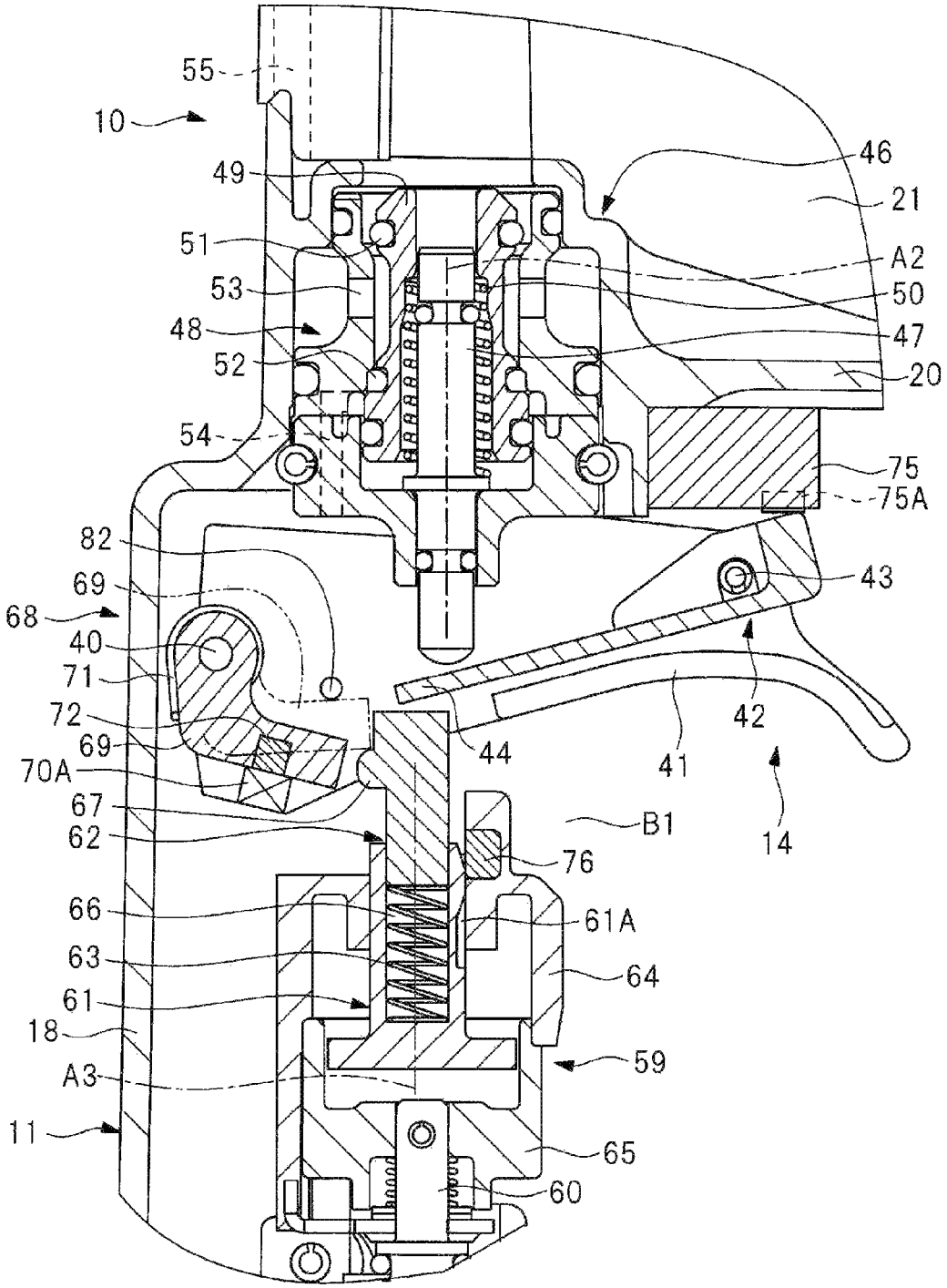
FIG. 10 is a partial cross-sectional view showing a first modified example of the first embodiment of the driving tool.

(First modified example of first embodiment) The first modified example of the driving tool 10 will be described with reference to FIG. 10. FIG. 10 shows a state where the trigger 14 is operated and the pin 62 extending from the push lever (not shown) and operated by the push lever is not operated. The same structures as those shown in FIGS. 1, 2 and 3 are denoted by the same reference numerals as those shown in FIGS. 1, 2 and 3. The stopper 69 is urged in the counterclockwise direction in FIG. 10 by the urging member 71. A pin 82 is provided on the trigger 14. An electromagnet 70A is provided on the trigger 14. The electromagnet 70A has a polarity different from that of the permanent magnet 72 when power is supplied. When the supply of power to the electromagnet 70A stops, the stopper 69 urged by the urging member 71 comes into contact with the pin 82 and stops at the initial position indicated by the two-dot chain line. When power is supplied to the electromagnet 70A and the electromagnet 70A generates a magnetic force, the stopper 69 operates in the clockwise direction against the urging force of the urging member 71, contacts the electromagnet 70A, and stops at the operating position indicated by the solid line. The driving tool 10 of FIG. 10 has the control system shown in FIG. 5. The electromagnet 70A is an example of the actuator 80.

Next, a usage example of the driving tool 10 of the first modified example will be described. When the operator selects the first mode, the supply of power to the electromagnet 70A stops. In the state where the trigger 14 stops at the initial position, the tip of the stopper 69 is located outside the operating range of the engaging part 67 in the first modified example as in the first embodiment shown in FIG. 4.

When the trigger 14 is in the initial state and the operator brings the push lever 16 into contact with the workpiece 81 and the push lever 16 operates from the initial position, the pin 62 is operable. If the trigger 14 is rotated in this state, since both the operating force from the push lever and the operating force of the trigger 14 are applied to the trigger arm, the trigger valve 46 switches from the initial state to the operating state, and the striking part 13 operates from the top dead center toward the bottom dead center. Further, the operation of the pin 62 is not blocked by the stopper 69 in the process in which the push lever 16 separates from the workpiece 81 and the pin 62 returns from the operating position to the initial position. The principle is the same as in the first embodiment of the driving tool 10.

Next, in the driving tool 10 shown in FIG. 10, when the operator selects the second mode, the control part 77 can perform the first control example in FIG. 9. When the control part 77 supplies power to the actuator (electromagnet 70A) in step S5 of FIG. 9, the stopper 69 operates from the initial position indicated by the two-dot chain line to the operating position indicated by the solid line and stops at the operating position.

When the stopper 69 stops at the operating position, the stopper 69 is located outside the operating range of the engaging part 67 regardless of whether the trigger 14 is operated. Therefore, when the push lever 16 is pressed against the workpiece 81 and operates after the trigger 14 is rotated, the stopper 69 does not block the operation of the pin 62. Therefore, the trigger valve 46 switches from the initial state to the operating state, and the striking part 13 operates from the top dead center toward the bottom dead center.

Further, when the control part 77 stops the supply of power to the electromagnet 70A in step S4 or S10 of FIG. 9, the stopper 69 stops at the initial position in contact with the pin 82. Next, when the operator separates the push lever 16 from the workpiece 81, since the stopper 69 is rotatable in the clockwise direction in the process in which the pin 62 returns from the operating position to the initial position, the stopper 69 does not block the operation of the pin 62. The principle is the same as in the first embodiment of the driving tool 10.

As described above, the first modified example of the driving tool 10 can obtain the same effect as that of the first embodiment of the driving tool 10.

Figure 11:
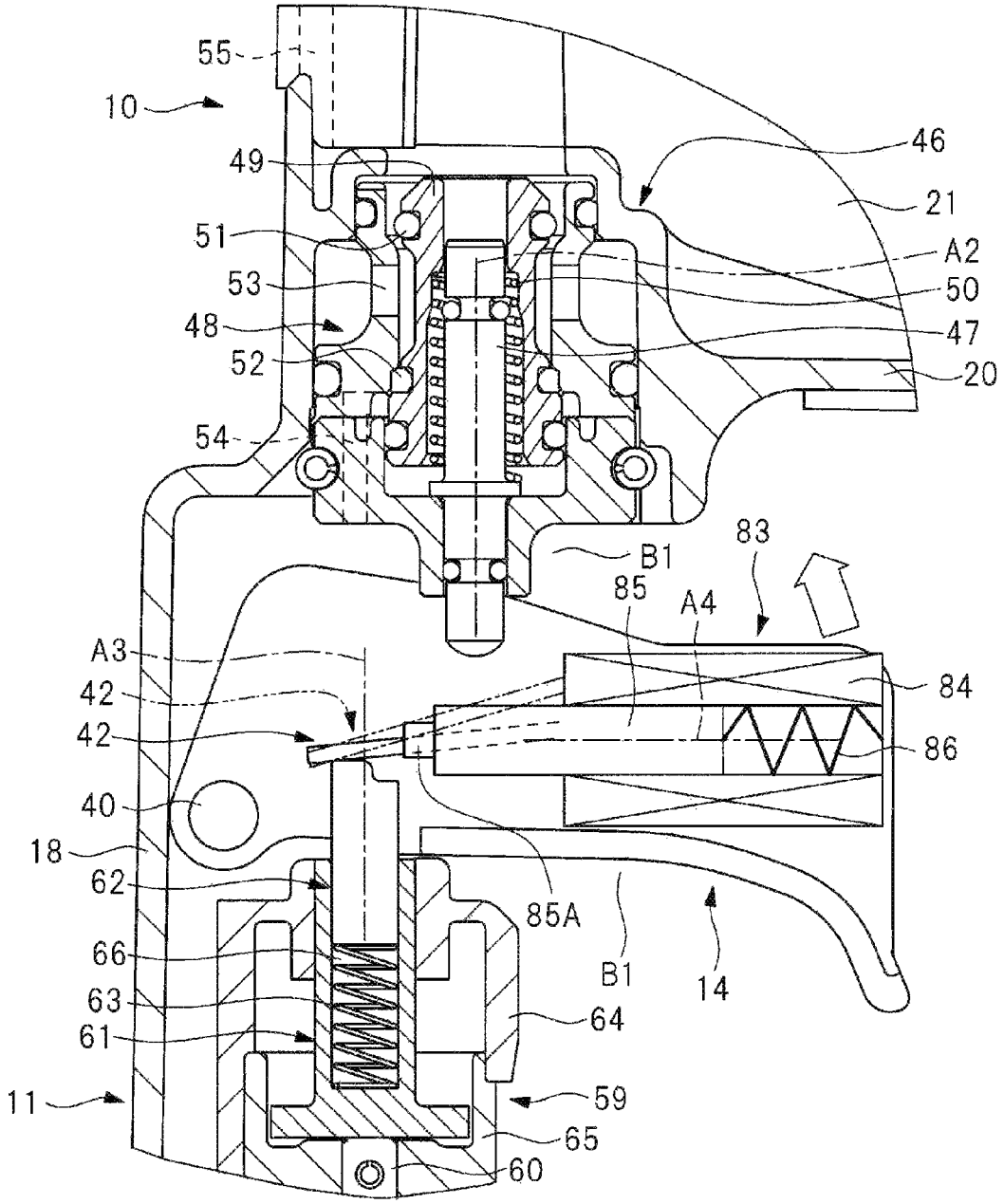
FIG. 11 is a front cross-sectional view showing a second modified example of the first embodiment of the driving tool in a state where the trigger and the push lever are in the initial positions in the second mode.

(Second modified example of first embodiment) The second modified example of the driving tool 10 is shown in FIG. 11. A solenoid 83 is provided on the trigger 14 as a restricting mechanism. The solenoid 83 has a function of preventing the operating force of the push lever 16, specifically, the operating force of the pin 62, from being transmitted to the plunger 47. The solenoid 83 has a coil 84, a plunger 85, and an urging member 86. The plunger 85 is made of a magnetic material and is movable in the direction of a center line A4. The center line A4 intersects with the center line A3. The urging member 86 is, for example, a metal spring. The plunger 85 is urged by the urging force of the urging member 86 in a direction to approach the pin 62 and stops at the initial position. The coil 84 generates a magnetic force when power is supplied, and urges the plunger 85 in a direction away from the pin 62, and the plunger 85 stops at the operating position. The second modified example of the driving tool 10 has the control system shown in FIG. 5. The solenoid 83 is an example of the actuator 80. Also, the trigger arm 42 is urged in the counterclockwise direction in FIG. 11, and the trigger 14 is urged in the clockwise direction in FIG. 11.

Figure 12:
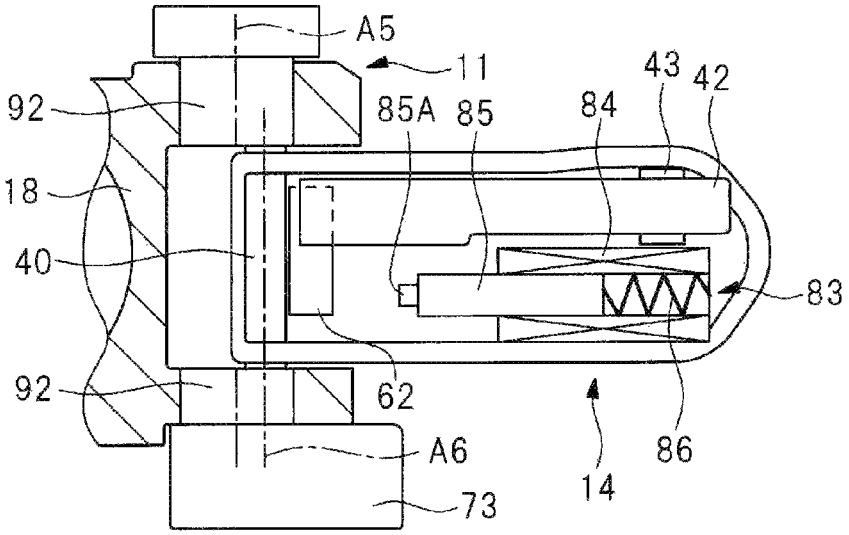
FIG. 12 is a cross-sectional plan view of the second modified example of the first embodiment of the driving tool in a case where the first mode is selected.
Figure 13:
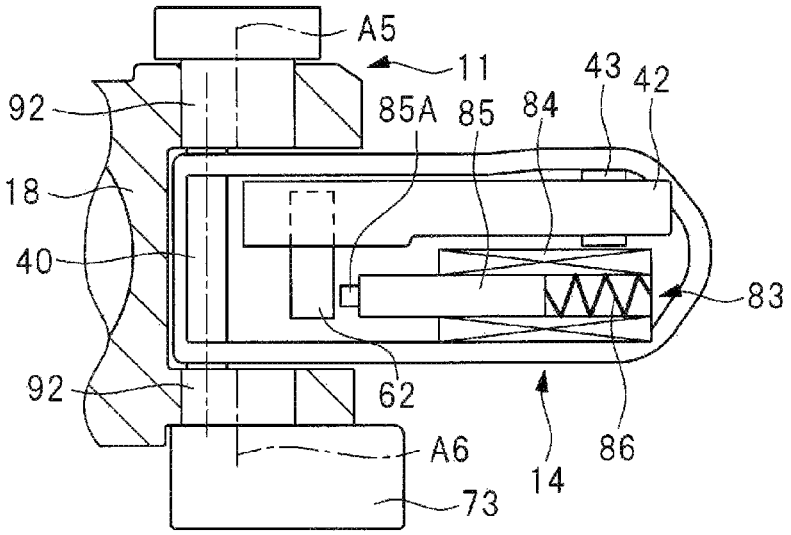
FIG. 13 is a cross-sectional plan view of the second modified example of the first embodiment of the driving tool in a case where the second mode is selected.

Further, the trigger 14 is supported by the main body 11 via a main shaft 92 and the support shaft 40 as shown in FIGS. 12 and 13. The main shaft 92 has a columnar shape, and the main shaft 92 is rotatable about a center line A5. The mode selection member 73 is attached to the main shaft 92. The support shaft 40 is disposed about a center line A6 that is eccentric from the center line A5 of the main shaft 92. When the operator operates the mode selection member 73, the main shaft 92 rotates, and the main shaft 92 can stop at a position corresponding to the first mode or the second mode.

Figure 14:
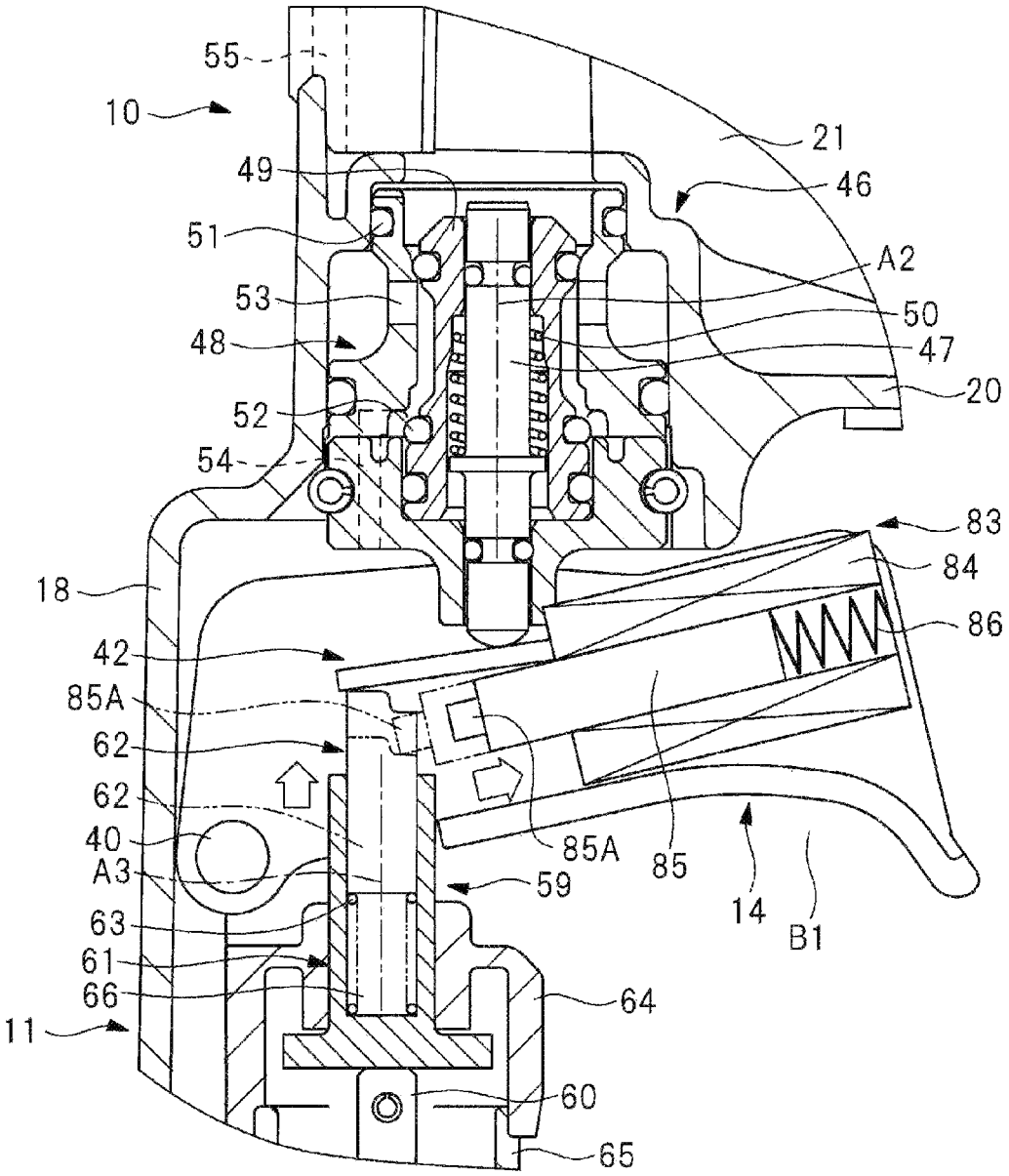
FIG. 14 is a front cross-sectional view showing the second modified example of the first embodiment of the driving tool in a state where the trigger and the push lever are in the operating positions in the second mode.
Figure 15:
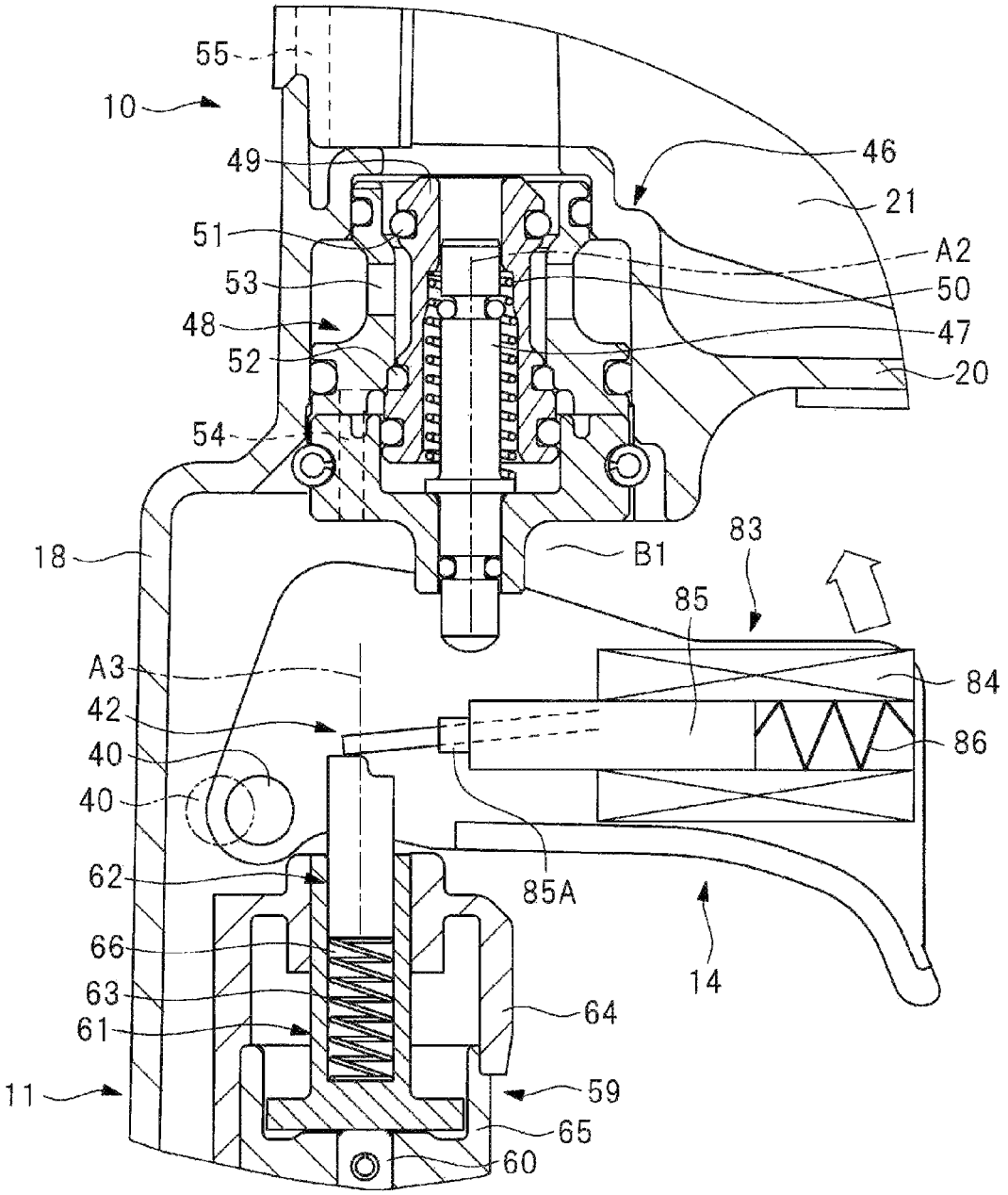
FIG. 15 is a front sectional view showing the second modified example of the first embodiment of the driving tool in a state where the trigger and the push lever are in the initial positions in the first mode.

In a state where the plunger 85 stops at the initial position, the distance between the plunger 85 and the pin 62 when the operator selects the first mode is longer than the distance between the plunger 85 and the pin 62 when the operator selects the second mode. FIGS. 12 and 15 show the position of the plunger 85 when the first mode is selected. FIGS. 11, 13 and 14 show the position of the plunger 85 when the second mode is selected. Other structures of the driving tool 10 according to the second modified example are the same as those of the driving tool 10 according to the first embodiment.

(Example of selecting the first mode) In the second modified example of the driving tool 10, when the operator selects the first mode, power is not supplied to the control part 77 shown in FIG. 5, and the control part 77 stops. When the operator selects the first mode, power is not supplied to the solenoid 83, and the plunger 85 stops at the initial position. The plunger 85 is located outside the operating range of the pin 62.

When the operator selects the first mode and presses the push lever 16 against the workpiece 81, the pin 62 operates, and the trigger arm 42 operates. Next, when the operator applies an operating force to the trigger 14, the trigger valve 46 switches from the initial state to the operating state. Therefore, the striking part 13 operates from the top dead center toward the bottom dead center.

Thereafter, when the operator releases the operating force on the trigger 14 and separates the push lever 16 from the workpiece 81, the trigger valve 46 returns from the operating state to the initial state. When the operator releases the operating force on the trigger 14 and separates the push lever 16 from the workpiece 81 to return the pin 62 from the operating position to the initial position, the plunger 85 does not contact the pin 62.

(Example of selecting the second mode) In the second modified example of the driving tool 10, when the operator selects the second mode, power is supplied to the control part 77 shown in FIG. 5, and the control part 77 activates and can perform the same control as the control example of FIG. 9.

When the operator applies an operating force to the trigger 14, the control part 77 determines Yes in step S2, and the control part 77 detects in step S3 that the transmission control switch 91 is on. Then, as shown by the two-dot chain line in FIG. 14, the plunger 85 is located within the operating range of the pin 62 and restricts the operation of the pin 62. In this state, power is supplied to the actuator (solenoid 83) in step S5. Therefore, a tip 85A of the plunger 85 moves out of the operating range of the pin 62 and stops. Further, the trigger arm 42 operates from the initial position indicated by the solid line to the intermediate position indicated by the two-dot chain line in FIG. 11.

The control part 77, when the push lever sensor is on in step S6, in step S7, operates the striking part 13 from the top dead center to the bottom dead center.

Then, when the push lever 16 returns to the initial position and the push lever sensor 76 turns off in step S8, the control part 77 stops the supply of power to the solenoid 83 in step S10. Therefore, as described above, the second modified example of the driving tool 10 can obtain the same effect as that of the first embodiment of the driving tool 10.

Figure 16:
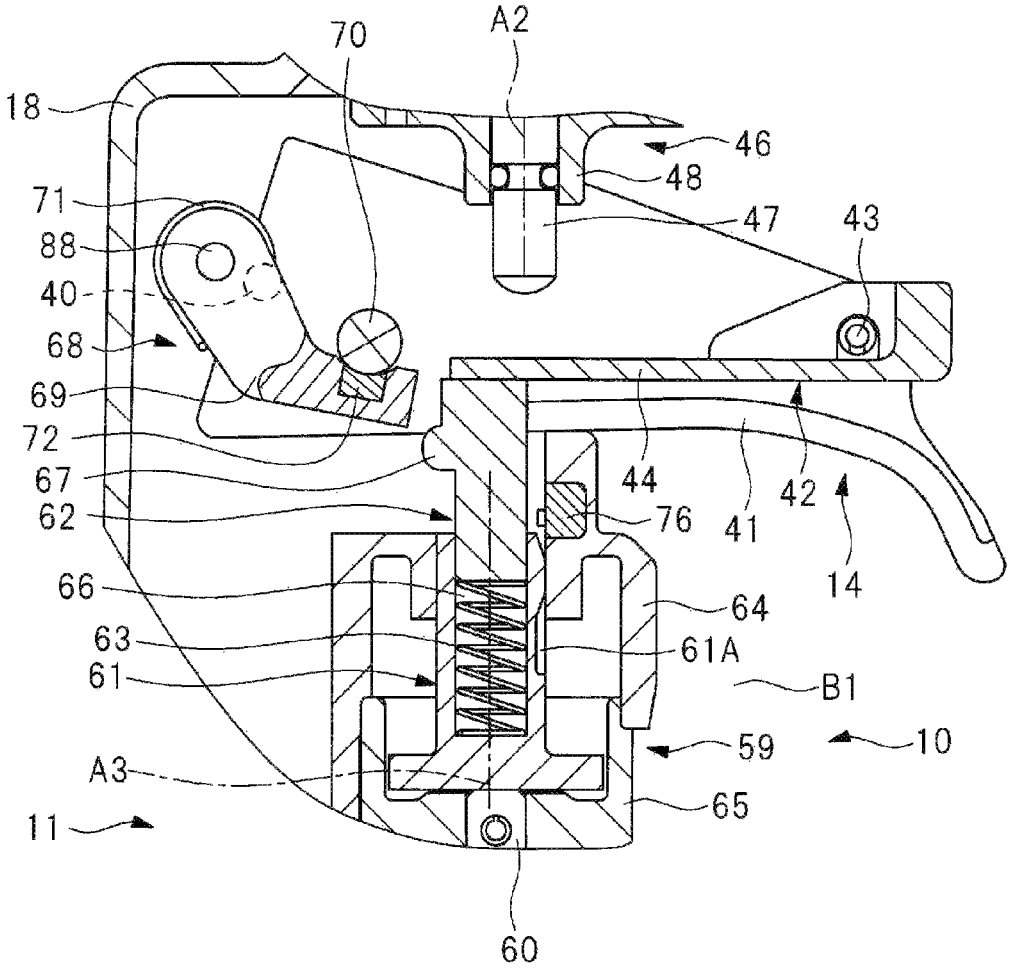
FIG. 16 is a partial cross-sectional view showing a third modified example of the first embodiment of the driving tool.

(Third modified example of first embodiment) FIG. 16 is a partial cross-sectional view of a third modified example of the driving tool 10. The stopper 69 is attached to the main body 11 to be operable about a support shaft 88. The support shaft 88 that supports the stopper 69 is a member different from the support shaft 40 that supports the trigger 14. Other structures in FIG. 16 are the same as those shown in FIG. 4. The control system of FIG. 5 can be used in the third modified example of FIG. 16. It is also possible to perform the control example of FIG. 9 in the third modified example of the driving tool 10.

Figure 17:
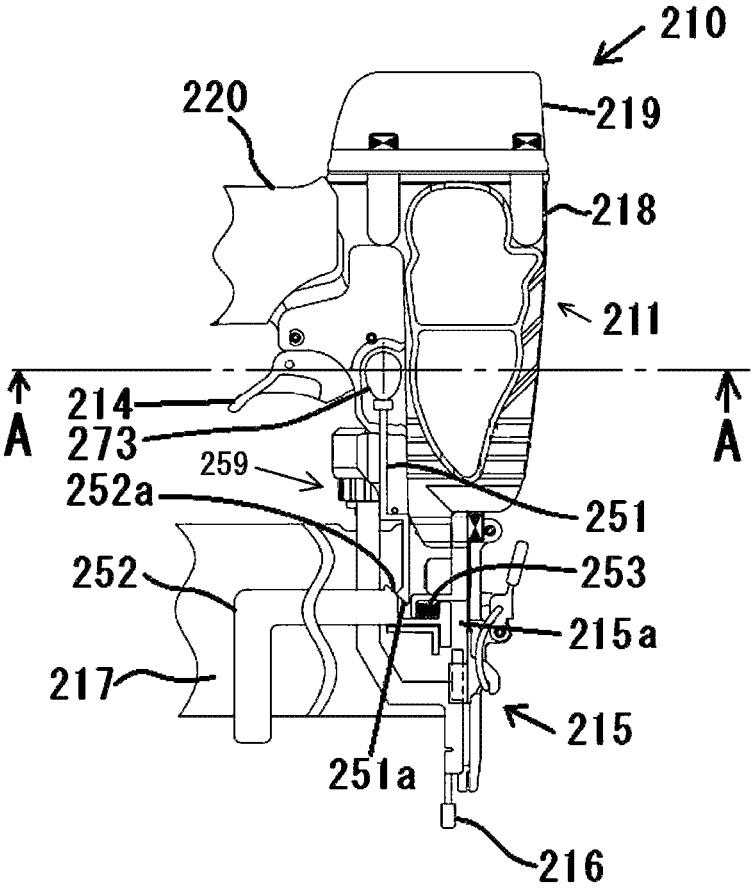
FIG. 17 is a side view showing a second embodiment (first mode) of the driving tool.

(Second embodiment) FIG. 17 is a side view showing a second embodiment of a driving tool 210, which is a driving tool that operates using compressed air as a compressible gas, like the first embodiment, and the configuration not described in detail is the same as that of the first embodiment.

The driving tool 210 has a trigger 214, an ejector 215 and a push lever 216, and is provided with a transmission mechanism 259. Further, a magazine 217 is attached to the driving tool 210. A main body 211 has a tubular body part 218, a head cover 219 fixed to the body part 218, and a handle 220 connected to the body part 218. The handle 220 protrudes from the outer surface of the body part 218. Further, a transmission control part 252 urged by an urging member 253 in the direction of the ejector 215 is provided on the side of the magazine 217.

A mode selection member 273 is provided on the main body 211. The mode selection member 273 is, for example, a lever that is operable within a range of a predetermined angle. The mode selection member 273 has a first operating position corresponding to a first mode and a second operating position corresponding to a second mode. In the first mode, the operator applies an operating force to the trigger 214 in a state where the push lever 216 is in contact with a workpiece. Further, in the second mode, the push lever 216 is brought into contact with the workpiece in a state where the operator has applied an operating force to the trigger 214.

The operator operates the mode selection member 273 to select the first mode or the second mode in a state where the operating force applied to the trigger 214 is released and the push lever 216 separates from the workpiece. The mode selection member 273 is urged by a mode selection urging member 254 in one direction (for example, in the direction of the rotation axis), and is provided with recesses into which joint balls (not shown) are fitted at two positions, the first operating position and the second operating position. Therefore, in both the first mode and the second mode, the position of the mode selection member 273 is fixed so that the selected mode is maintained after the operator performs the switching operation.

Figure 19:
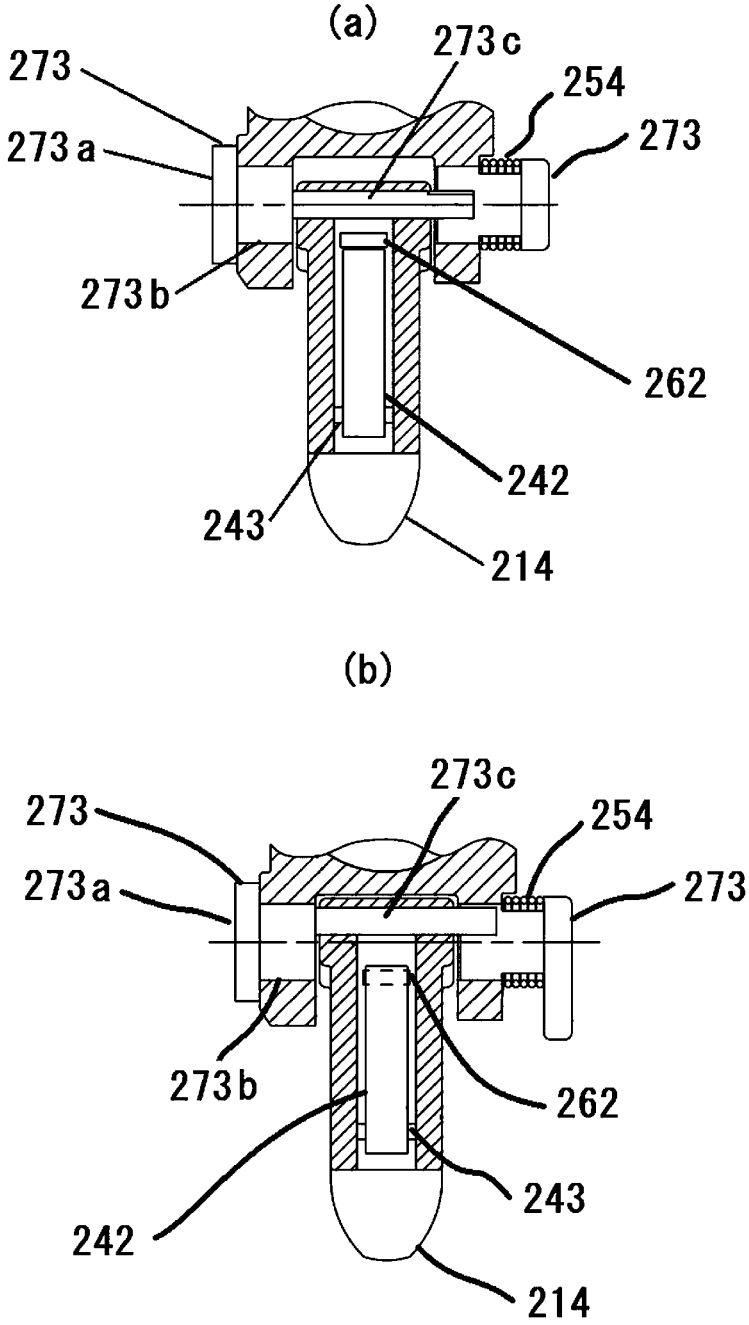
FIG. 19 is a cross-sectional view taken along the line A-A of the driving tool according to the second embodiment.

(Example of selecting the first mode) FIG. 17 shows a case where the operator selects the first mode. In FIG. 17, the mode selection member 273 has an eccentric circle shape. Then, the restricting member 251 is urged by an urging member (not shown) into contact with the mode selection member 273. Further, as shown in (a) of FIG. 19, a pin part 273*a* of the mode selection member 273 has a shaft part 273*c* that is eccentric with respect to a rotation shaft 273*b*, and the trigger 214 is moved in the downward direction in the drawing by the shaft part 273*c*. As a result, an end of a trigger arm 242 rotatably engaged with a rotation shaft 243 is provided at a position close to a pin 262 which extends from the push lever 216 and which is slidably engaged.

Like the first embodiment, in the first mode, in the trigger arm 242 and the pin 262, the end of the trigger arm 242 and the pin 262 contact each other when the push lever operates first. Then, when the operator applies an operating force to rotate the trigger 214, the operating force from the pin 262 is transmitted to the trigger arm 242, and the operating force from the push lever and the operating force of the trigger 214 cooperate to drive the trigger valve 46. On the contrary, when the operator operates the trigger before the operation of the push lever, the engagement between the end of the trigger arm 242 and the pin 262 is released.

In the first mode, the restricting member 251 contacts at the position farthest from the rotation shaft of the mode selection member 273, and as a result, moves in the downward direction in the drawing against the urging force. Further, the restricting member 251 has an inclined part 251*a* at its lower end, and the transmission control part 252 has a contact part 252*a* at a position facing the inclined part.

In the first mode, as a result of the restricting member 251 moving downward, the transmission control part 252 moves in the leftward direction in the drawing against the urging force of the urging member 253 by the contact part 252*a* that contacts the inclined part 251*a* of the restricting member 251.

Therefore, in the first mode, since the transmission control part 252 is moved to a position that does not restrict the push lever 216, a push lever restricting region 215*a* in FIG. 17 becomes a space and does not block the sliding of the push lever 216. Therefore, in this state, the striking part is operated by operating the trigger 214 after sliding the push lever 216 by bringing the push lever 216 into contact with the workpiece.

Figure 18:
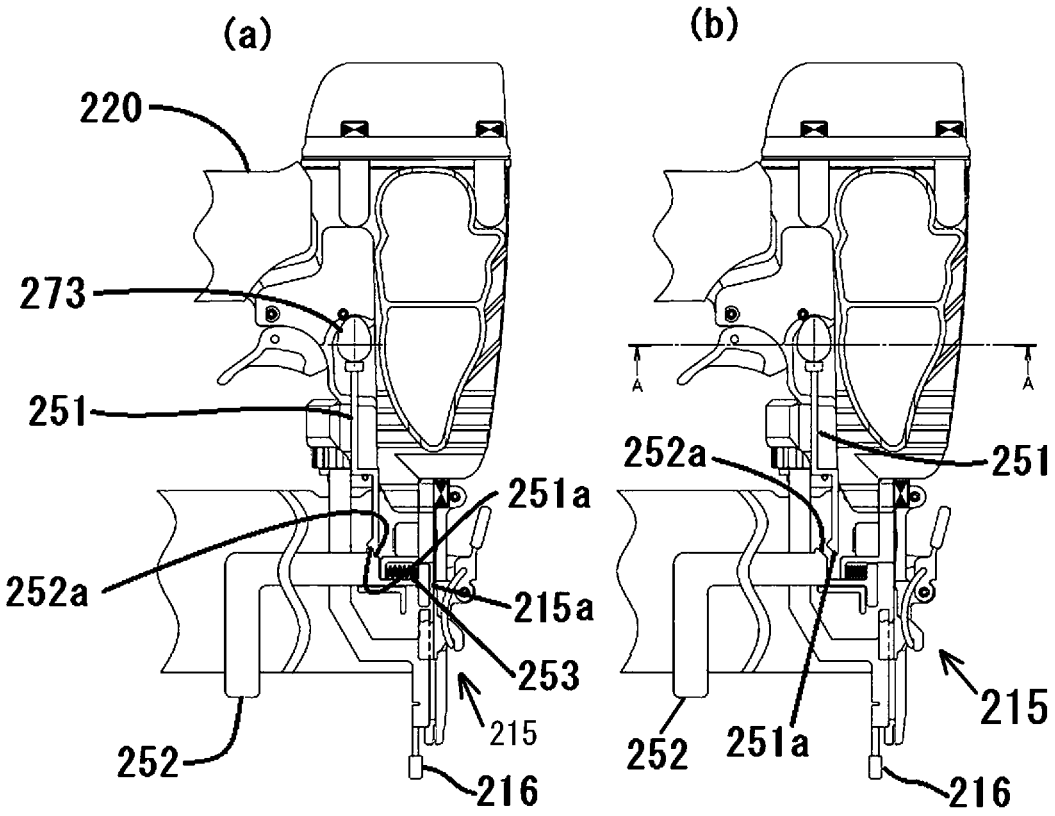
FIG. 18 is a side view showing the second embodiment (second mode) of the driving tool.

(Example of selecting the second mode) When the second mode is selected, first, as shown in (a) of FIG. 18, the mode selection member 273 rotates, whereby the restricting member 251 contacts the mode selection member 273 at a position closest to the rotation shaft, and as a result, it is held at a position in the upper region in the drawing by the urging force. Further, as shown in (b) of FIG. 19, by the eccentric shaft part 273*c*, the trigger 214 is moved in the upward direction in the drawing. As a result, the end of the trigger arm 242 rotatably engaged with the rotation shaft 243 is provided at a position always in contact with the pin 262 which extends from the push lever 216 and which is slidably engaged, and regardless of the order of the operation of the push lever and the rotation of the trigger 214, the operating force from the push lever and the operating force of the trigger 214 cooperate to drive the trigger valve 46.

In the second mode, as a result of the restricting member 251 moving upward, the transmission control part 252 moves in the rightward direction in the drawing by the urging member 253. Therefore, in the initial state of the second mode, since the transmission control part 252 is moved to a position that restricts the push lever 216, the push lever restricting region 215*a* in (a) of FIG. 18 becomes closed, and the sliding of the push lever 216 is restricted.

Here, (b) of FIG. 18 shows a state where the transmission control part 252 has been moved by the operator in the leftward direction in the drawing against the urging member 253. In this state, since the transmission control part 252 is moved to a position that does not restrict the push lever 216, the push lever restricting region 215*a* as shown in (b) of FIG. 18 becomes a space and does not block the sliding of the push lever 216.

Therefore, in the second mode, when the transmission control part 252 is not operated by the operator, as shown in (a) of FIG. 18, the push lever is restricted, and the operation of the striking part is restricted. On the contrary, after the trigger 214 is operated, the operator performs an operation of moving the transmission control part 252 and then operates the push lever 216 to allow the operation of the striking part, as shown in (b) of FIG. 18.

Figure 20:
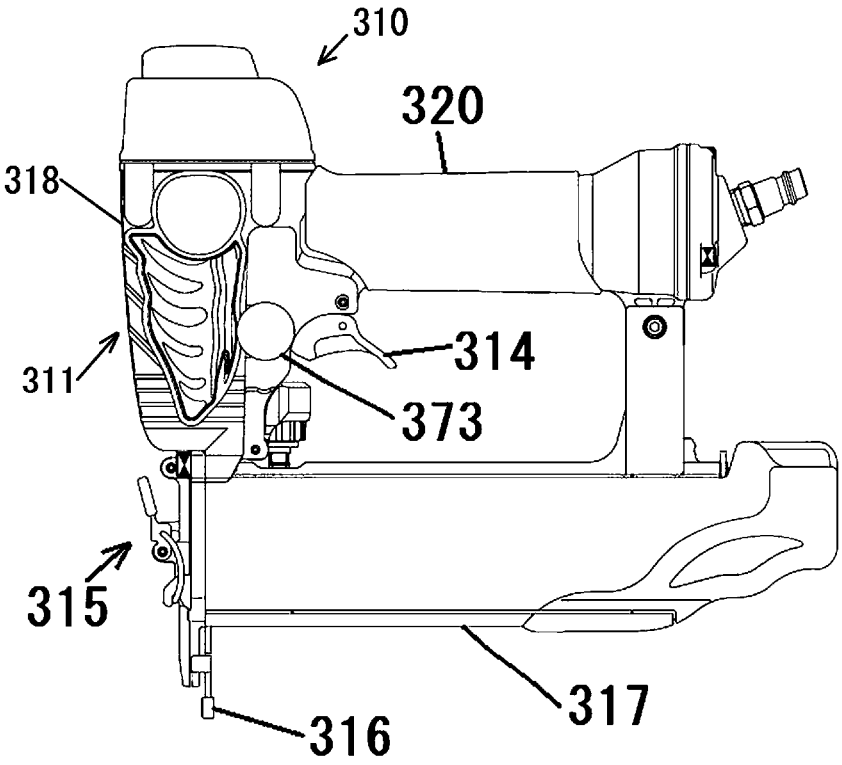
FIG. 20 is a front view of a driving tool according to a third embodiment.
Figure 21:
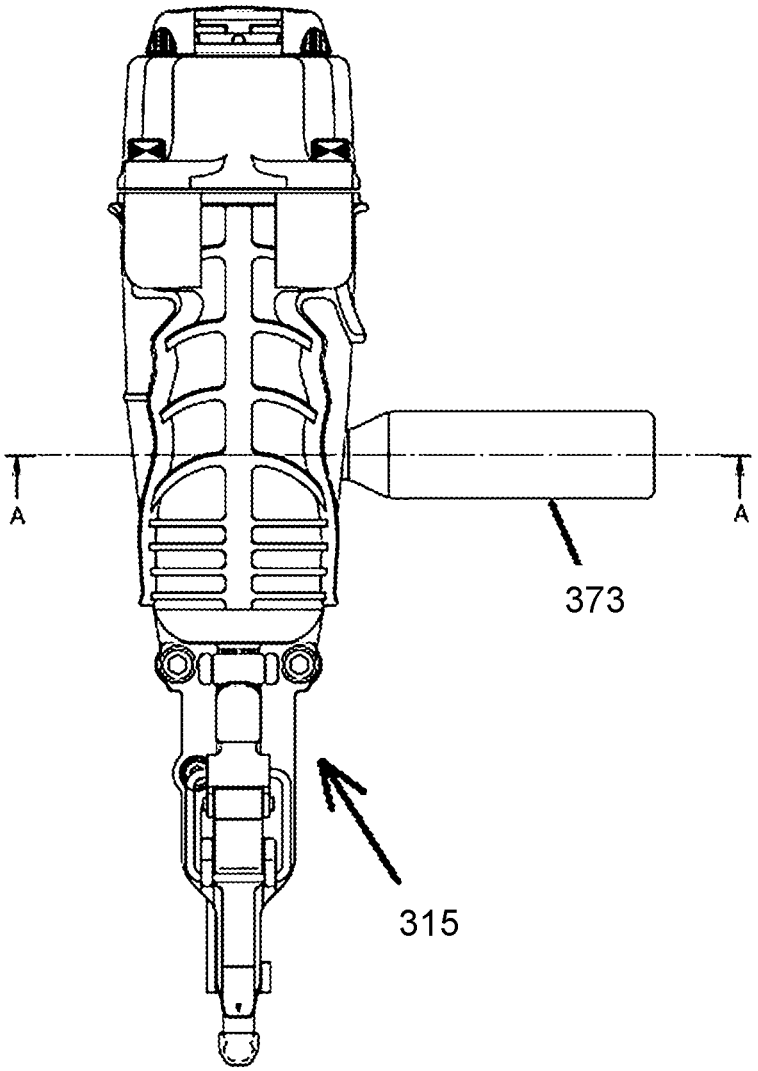
FIG. 21 is a side view of the driving tool according to the third embodiment.

(Third embodiment) FIG. 20 and FIG. 21 are a front view and a side view showing a third embodiment of a driving tool 310, which is a driving tool that operates using compressed air as a compressible gas, like the first embodiment and the like, and the configuration not described in detail is the same as that of the first embodiment or the second embodiment.

The driving tool 310 has a trigger 314, an ejector 315 and a push lever 316. Further, it has a tubular body part 318 and a handle 320, and a magazine 317 is attached to the driving tool 310. The handle 320 protrudes from the outer surface of the body part 318, and a sub handle 373 is provided in a direction intersecting with the handle 320. Further, a mode selection member 373A is provided on a main body 311. The mode selection member 373A is, for example, a lever that is operable within a range of a predetermined angle, and the sub handle 373 is provided on an extension line of the rotation shaft thereof. In the embodiment, for example, it is assumed that the operator holds the handle 320 with the right hand and holds the sub handle 373 with the left hand.

The mode selection member 373A has a first operating position corresponding to a first mode and a second operating position corresponding to a second mode. In the first mode, the operator applies an operating force to the trigger 314 in a state where the push lever 316 is in contact with a workpiece. Further, in the second mode, the push lever 316 is brought into contact with the workpiece in a state where the operator has applied an operating force to the trigger 314.

The operator operates the mode selection member 373A by rotating the sub handle 373 to select the first mode or the second mode in a state where the operating force applied to the trigger 314 is released and the push lever 316 separates from the workpiece. The mode selection member 373A is urged in the rotating direction by a mode selection urging member 324, and the first mode is maintained when the operator is not performing the rotating operation. That is, in the second mode, the mode can be selected only when the operator holds the sub handle in a rotated state, and when the sub handle is not rotated or when the sub handle is not grasped, only the first mode can be selected.

Figure 22:
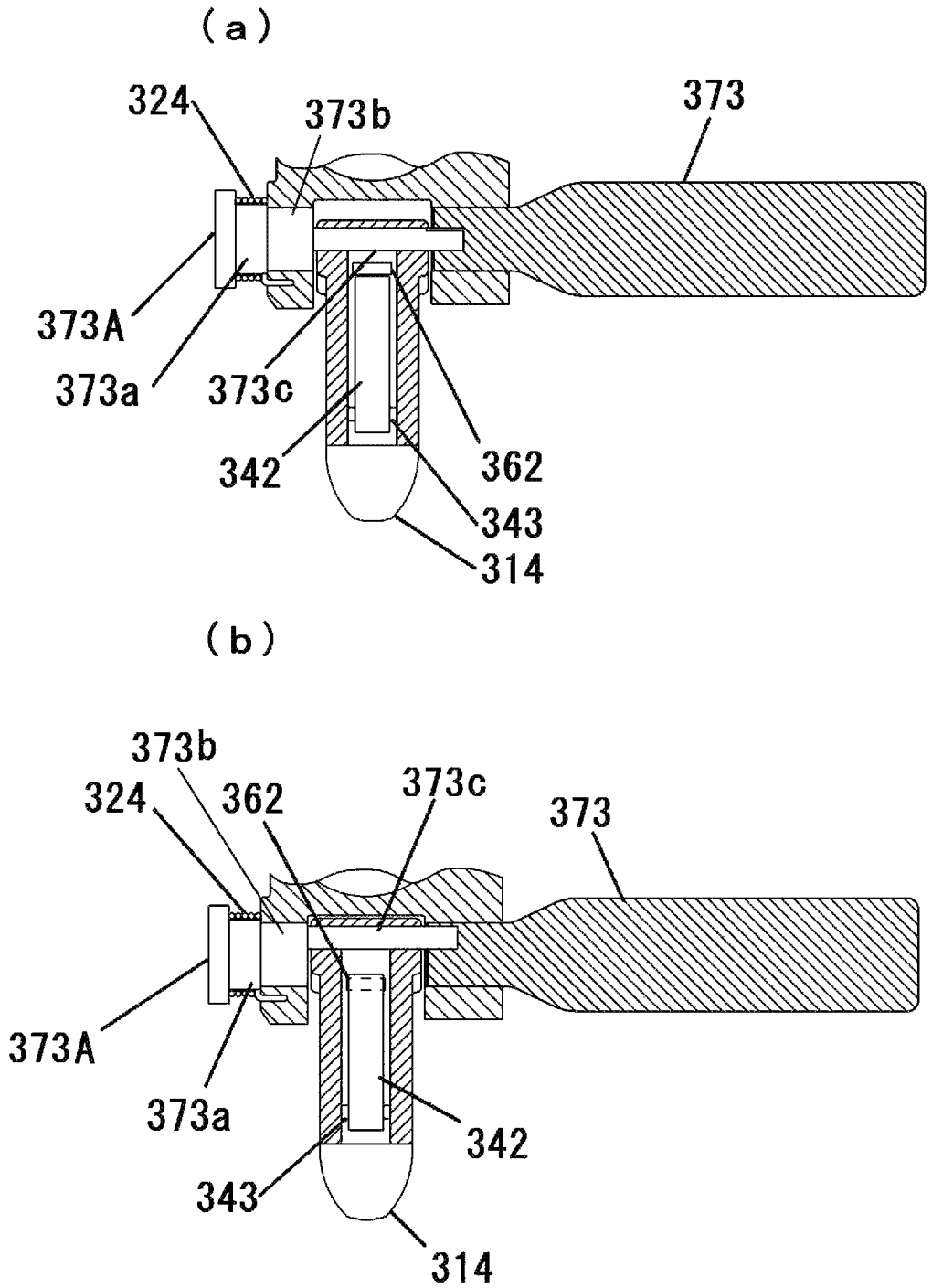
FIG. 22 is a cross-sectional view taken along the line A-A of the driving tool according to the third embodiment.

(Example of selecting the first mode) (a) of FIG. 22 shows a case where the operator selects the first mode, that is, a case where the sub handle is not operated. Further, as shown in (a) of FIG. 22, the mode selection member 373A has a pin part 373*a* and a shaft part 373*c* that is eccentric with respect to a rotation shaft 373*b*, and the trigger 314 is moved in the downward direction in the drawing by the shaft part 373*c*. As a result, an end of a trigger arm 342 rotatably engaged with a rotation shaft 343 is provided at a position close to the pin 362 which extends from the push lever 316 and which is slidably engaged.

Like the first embodiment or the second embodiment, in the first mode, in the trigger arm 342 and the pin 362, the end of the trigger arm 342 and the pin 362 contact each other when the push lever operates first. Then, when the operator applies an operating force to rotate the trigger 314, the operating force from the pin 362 is transmitted to the trigger arm 342, and the operating force from the push lever and the operating force of the trigger 314 cooperate to drive the trigger valve 46. On the contrary, when the operator operates the trigger before the operation of the push lever, the engagement between the end of the trigger arm 342 and the pin 362 is released.

(Example of selecting the second mode) When the operator intends to select the second mode, as described above, the operator grasps the sub handle 373 and performs the rotating operation, and thus as shown in (b) of FIG. 22, by the rotation of the mode selection member 373A, the trigger 314 is moved in the upward direction in the drawing by the eccentric shaft part 373*c*. As a result, the end of the trigger arm 342 rotatably engaged with the rotation shaft 343 is provided at a position always in contact with the pin 362 which extends from the push lever 316 and which is slidably engaged, and regardless of the order of the operation of the push lever 316 and the rotation of the trigger 314, the operating force from the push lever 316 and the operating force of the trigger 314 cooperate to drive the trigger valve 46.

That is, the operation in the case of selecting the second mode in the embodiment is configured so that the operator actively rotates the sub handle 373 and performs driving when the second mode is selected after holding the handle 320 with one hand and holding the sub handle 373 with the other hand. Therefore, the sub handle 373 functions as the transmission control part of the disclosure, as in the above-described embodiments.

Figure 23:
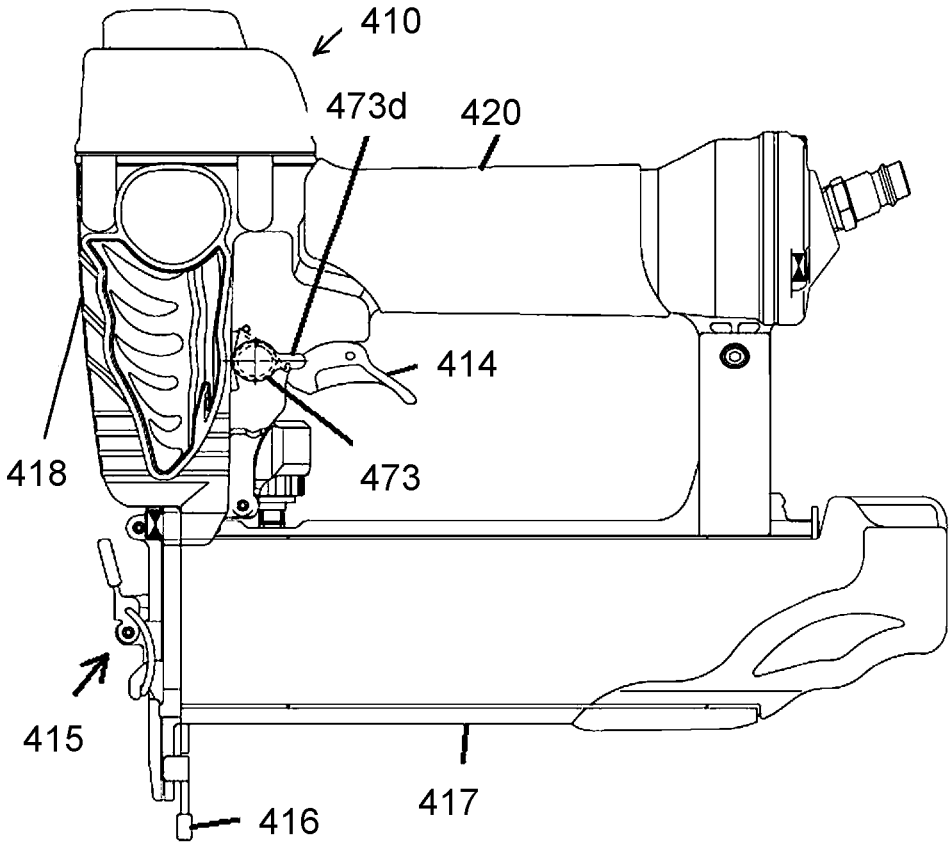
FIG. 23 is a front view showing a first modified example of the third embodiment of the driving tool.
Figure 24:
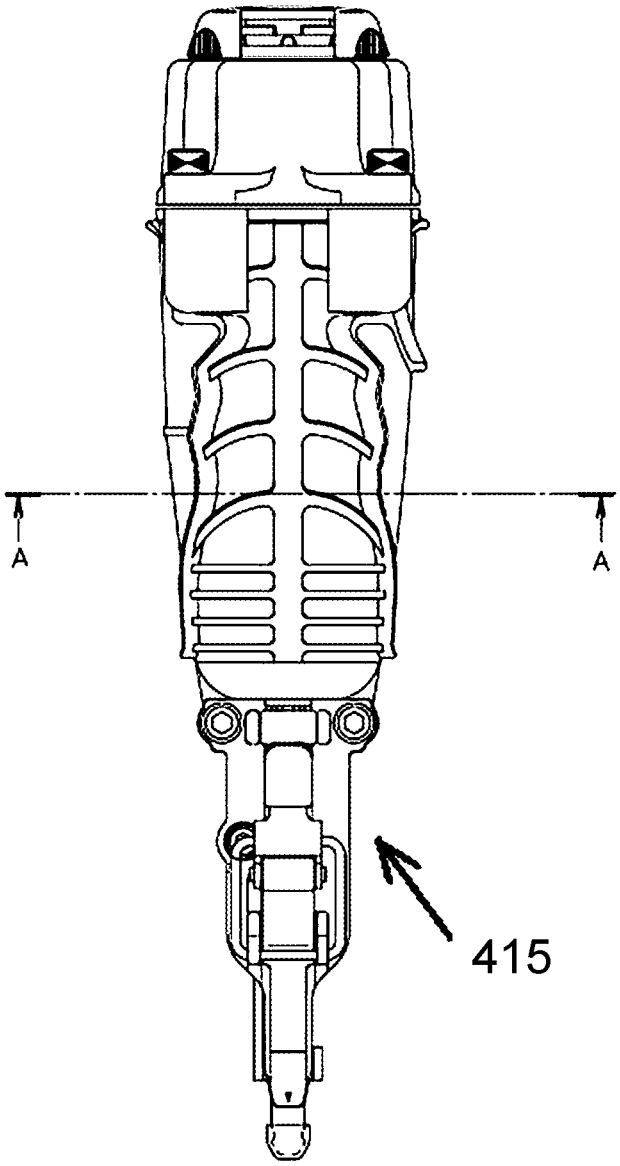
FIG. 24 is a side view showing the first modified example of the third embodiment of the driving tool.

(First modified example of third embodiment) FIG. 23 and FIG. 24 are a front view and a side view showing a first modified example of the third embodiment of a driving tool 410, which is a driving tool that operates using compressed air as a compressible gas, like the above-described embodiments, and the configuration not described in detail is the same as that of the third embodiment.

The driving tool 410 has a trigger 414, an ejector 415 and a push lever 416. Further, it has a tubular body part 418 and a handle 420, and a magazine 417 is attached to the driving tool 410. The handle 420 protrudes from the outer surface of the body part 418. Further, a mode selection member 473 is provided on a main body 411. The mode selection member 473 is, for example, a lever that is rotatable within a range of a predetermined angle, and on the outside thereof, a mode selection finger hook part 473*d* is provided at a position where work can be operated while the handle 420 is being held, that is, at a position where a finger can reach.

The mode selection member 473 has a first operating position corresponding to a first mode and a second operating position corresponding to a second mode. In the first mode, the operator applies an operating force to the trigger 414 in a state where the push lever 416 is in contact with a workpiece. Further, in the second mode, the push lever 416 is brought into contact with the workpiece in a state where the operator has applied an operating force to the trigger 414.

The operator rotates the mode selection member 473 to select the first mode or the second mode in a state where the operating force applied to the trigger 414 is released and the push lever 416 separates from the workpiece. The mode selection member 473 is maintained in the first mode by a mode selection urging member 424 when the operator is not performing the rotating operation. That is, the second mode can be selected only when the operator holds the mode selection member 473 in a rotated state.

Figure 25:
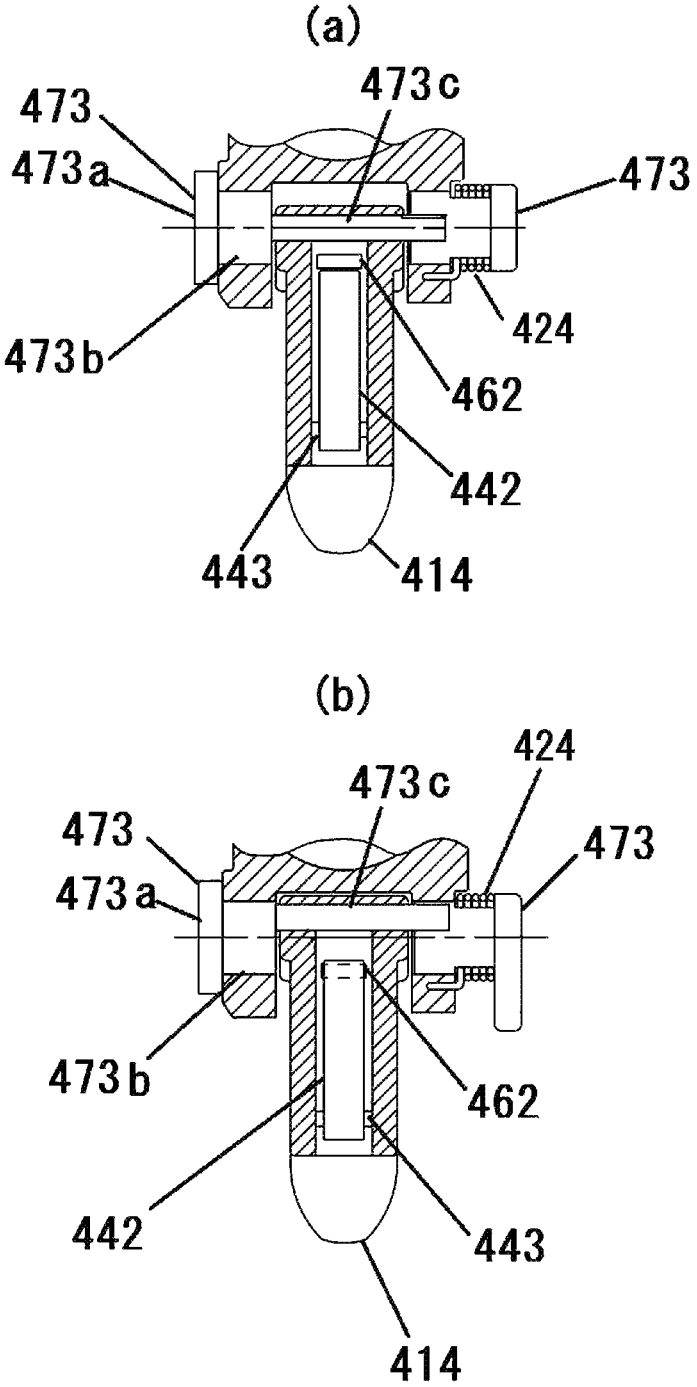
FIG. 25 is a cross-sectional view taken along the line A-A of the driving tool according to the first modified example of the third embodiment.

(Example of selecting the first mode) (a) of FIG. 25 shows a case where the operator selects the first mode, that is, a case where the mode selection member 473 is not operated. Further, as shown in (a) of FIG. 25, the mode selection member 473 has a pin part 473*a* and a shaft part 473*c* that is eccentric with respect to a rotation shaft 473*b*, and the trigger 414 is moved in the downward direction in the drawing by the shaft part 473*c*. As a result, an end of a trigger arm 442 rotatably engaged with a rotation shaft 443 is provided at a position close to the pin 462 which extends from the push lever 416 and which is slidably engaged.

Like the above-described third embodiment, in the first mode, in the trigger arm 442 and the pin 462, the end of the trigger arm 442 and the pin 462 contact each other when the push lever operates first. Then, when the operator applies an operating force to rotate the trigger 414, the operating force from the pin 462 is transmitted to the trigger arm 442, and the operating force from the push lever and the operating force of the trigger 414 cooperate to drive the trigger valve 46. On the contrary, when the operator operates the trigger 414 before the operation of the push lever, the engagement between the end of the trigger arm 442 and the pin 462 is released.

(Example of selecting the second mode) When the operator intends to select the second mode, as described above, the operator grasps the handle 420 and performs the rotating operation on the mode selection member 473, and thus as shown in (b) of FIG. 25, by the rotation of the mode selection member 473, the trigger 414 is moved in the upward direction in the drawing by the eccentric shaft part 473*c*. As a result, the end of the trigger arm 442 rotatably engaged with the rotation shaft 443 is provided at a position always in contact with the pin 462 which extends from the push lever 416 and which is slidably engaged, and regardless of the order of the operation of the push lever 416 and the rotation of the trigger 414, the operating force from the push lever 416 and the operating force of the trigger 414 cooperate to drive the trigger valve 46.

That is, the operation in the case of selecting the second mode in the embodiment is configured so that after holding the handle with one hand, the user operates the mode selection finger hook part 473*d* with some fingers of the holding hand, and after rotating the mode selection member 473 to actively select the second mode, the user operates the trigger 414 with other fingers and performs driving. Therefore, the mode selection finger hook part 473*d* functions as the transmission control part of the disclosure, as in the above-described embodiments.

In addition, in the first modified example of the third embodiment, the configuration in which the mode selection member 473 is urged to the first mode side by the rotating operation is illustrated, but a configuration in which the shaft part 473*c* causes an eccentric movement when the mode selection member 473 is slid in the extending direction of the rotation axis of the shaft part 473*c* may be used. For example, a spiral groove is provided in the mode selection member 473, and a protrusion that engages with the groove is provided in the body part 418 or the like, and by providing the mode selection urging member 424 to urge in the extending direction of the rotation axis of the shaft part 473*c*, instead of the mode selection finger hook part 473*d*, the operator may use the mode selection member 473 itself as the transmission control part operated by the hand holding the handle.

In the above-described modified example, an example of the disposition in which the operator can perform the trigger operation and the operation of the mode selection member with only one hand holding the handle has been illustrated, but instead of operating with only one hand, it goes without saying that the operator may operate with both hands. Further, the disposition of the mode selection member may be determined on the assumption that the trigger operation and the operation of the mode selection member are performed by different hands. In this case, for example, the handle can be held and the trigger can be operated with one hand, and the mode selection member can be operated with the other hand, as in the third embodiment.

Figure 26:
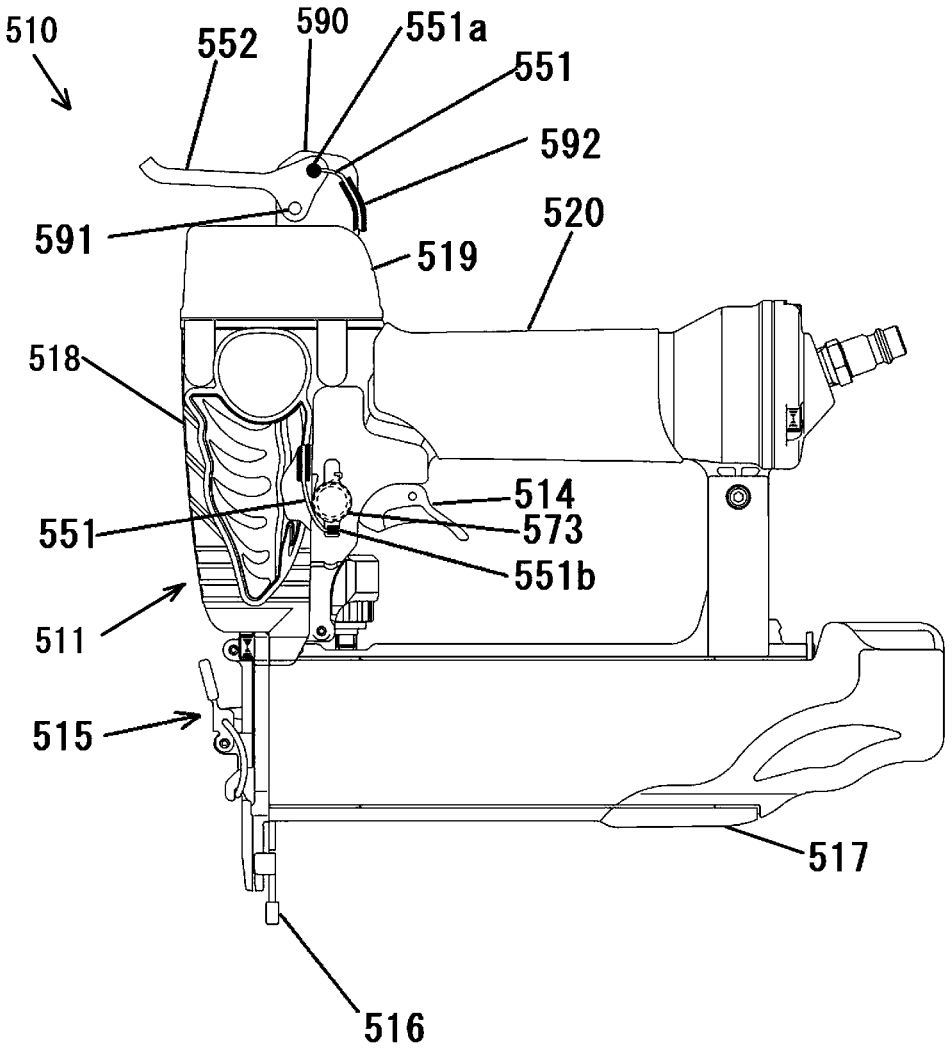
FIG. 26 is a front view showing a first mode of a second modified example of the third embodiment of the driving tool.
Figure 27:
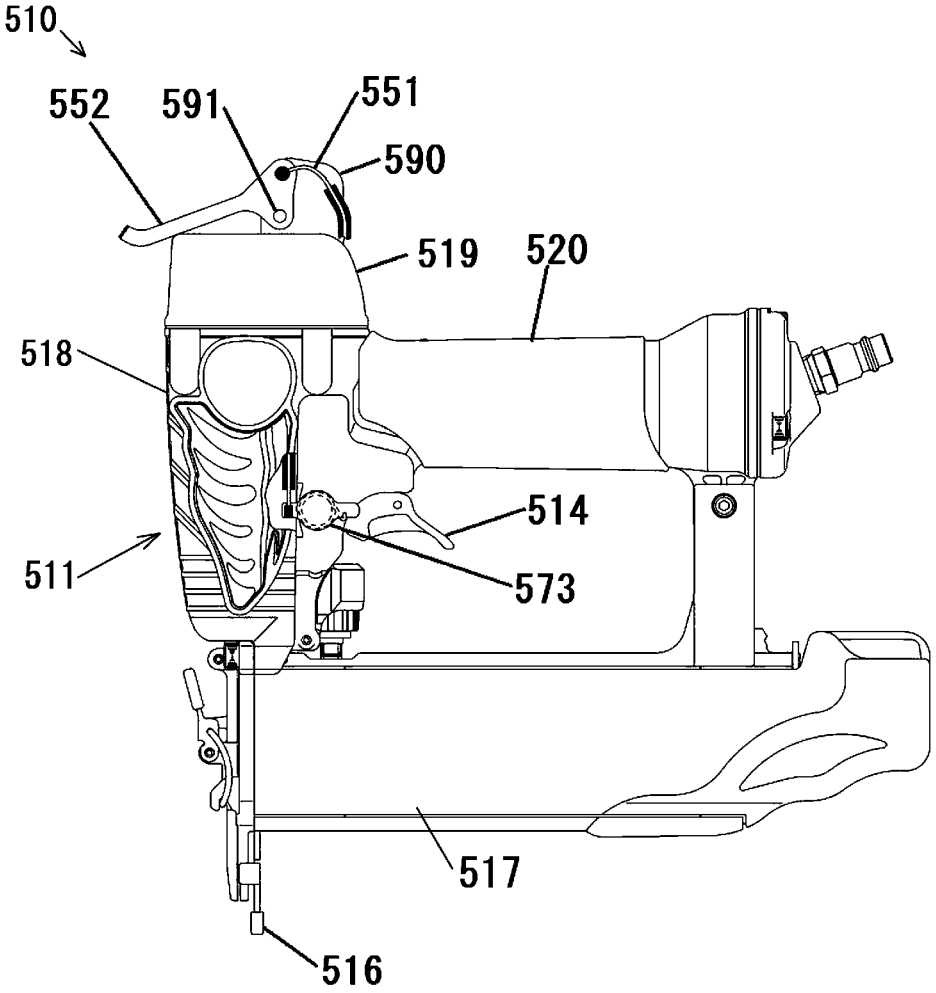
FIG. 27 is a front view showing a second mode of the second modified example of the third embodiment of the driving tool.
Figure 28:
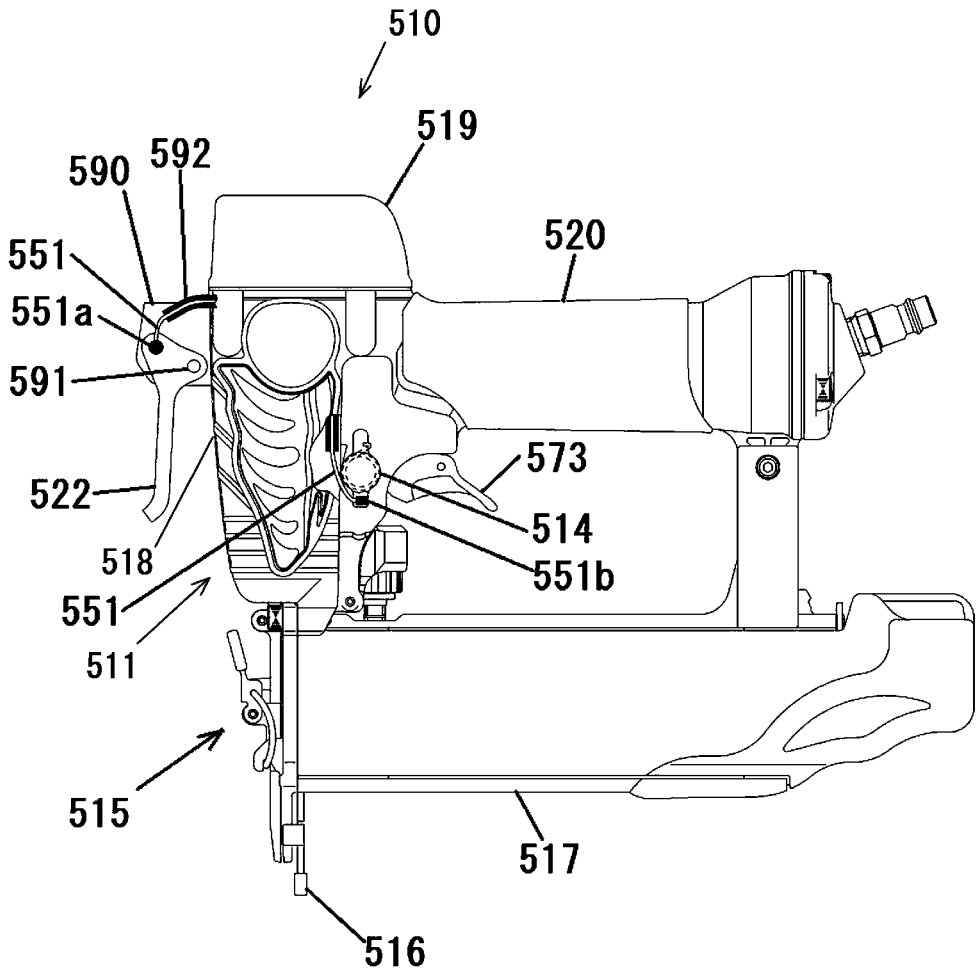
FIG. 28 is a front view showing a first mode of another aspect of the second modified example of the third embodiment of the driving tool.
Figure 29:
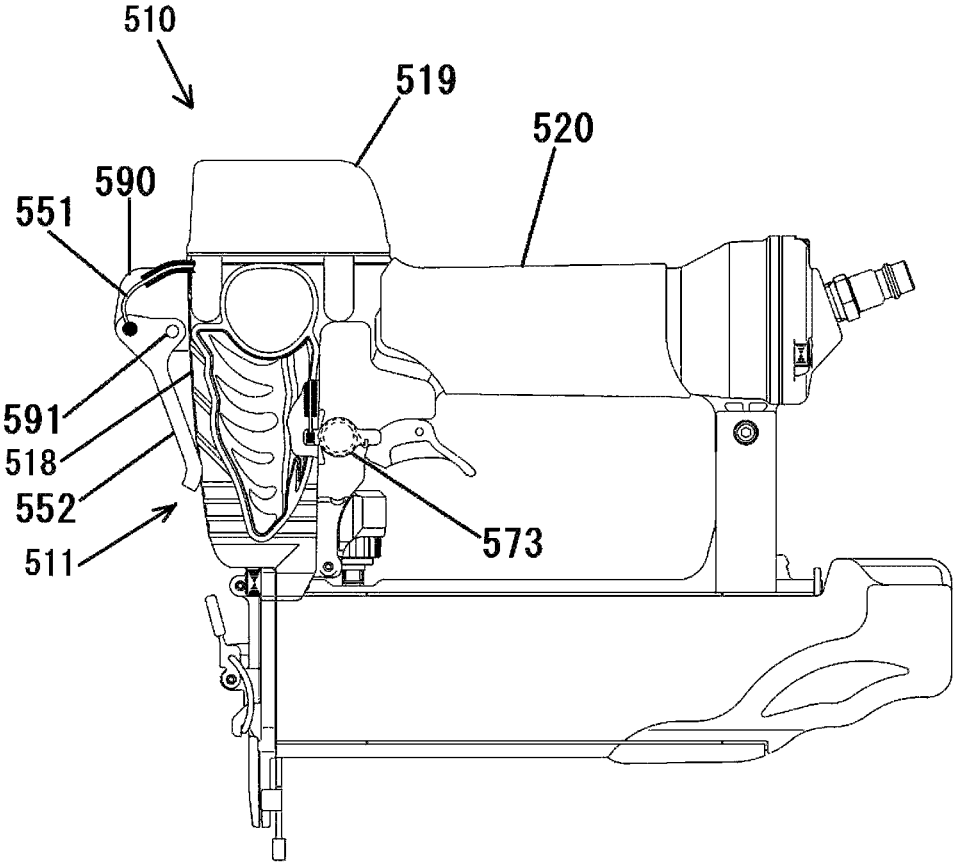
FIG. 29 is a front view showing a second mode of another aspect of the second modified example of the third embodiment of the driving tool.

(Second modified example of third embodiment) FIGS. 26 to 29 are two sets of front views showing a second modified example of the third embodiment of a driving tool 510, and FIGS. 26 and 28 show the state of the first mode, and FIGS. 27 and 29 show the structure when the second mode is selected. This driving tool operates using compressed air as a compressible gas, like the above-described embodiments, and the configuration not described in detail is the same as that of the third embodiment.

The driving tool 510 has a trigger 514, an ejector 515 and a push lever 516. Further, it has a tubular body part 518 and a handle 520, and a magazine 517 is attached to the driving tool 510. The handle 520 protrudes from the outer surface of the body part 518. Further, a mode selection member 573 is provided on a main body 511. The mode selection member 573 is, for example, a lever that is rotatable within a range of a predetermined angle. Further, a mode selection lever 552 is rotatably engaged with a head cover 519 or the body part 518 as a transmission control part 590 by a mode selection lever rotation shaft 591, and the mode selection lever 552 is connected to an end 551*a* of a wire 551, and the other end 551*b* of the wire 551 is connected to the mode selection member 573. Further, the wire 551 is guided by a guide member 592 attached to the head cover 519.

The mode selection member 573 has a first operating position corresponding to a first mode and a second operating position corresponding to a second mode, as in the above-described third embodiment and its modified examples. In the first mode, the operator applies an operating force to the trigger 514 in a state where the push lever 516 is in contact with a workpiece. Further, in the second mode, the push lever 516 is brought into contact with the workpiece in a state where the operator has applied an operating force to the trigger 514.

The operator rotates the mode selection member 573 by performing a rotating operation on the mode selection lever 552 to select the first mode or the second mode in a state where the operating force applied to the trigger 514 is released and the push lever 516 separates from the workpiece. The mode selection member 573 is maintained in the first mode by a mode selection urging member (not shown) when the operator is not performing the rotating operation. That is, the second mode can be selected only when the operator operates the mode selection lever 552 and holds the mode selection member 573 in a rotated state.

The specific structures and operations of each mode are the same as those of the above-described third embodiment and its modified examples, and thus will not be described. In this modified example, when the operator grasps the handle and operates the trigger with one hand, and performs the operation of the transmission control part 590 (that is, the mode selection member 573) with the other hand, it is possible to provide the mode selection lever 552 on the head cover 519 or the body part 518 which has good operability. Further, the distance from the rotation shaft 591 to the operation end of the mode selection lever 552 is set larger than the distance from the rotation shaft to the connection part of the wire 551, whereby the operating force of the mode selection lever can be reduced, and the fatigue of the driving work of the operator can be reduced.

Figure 30:
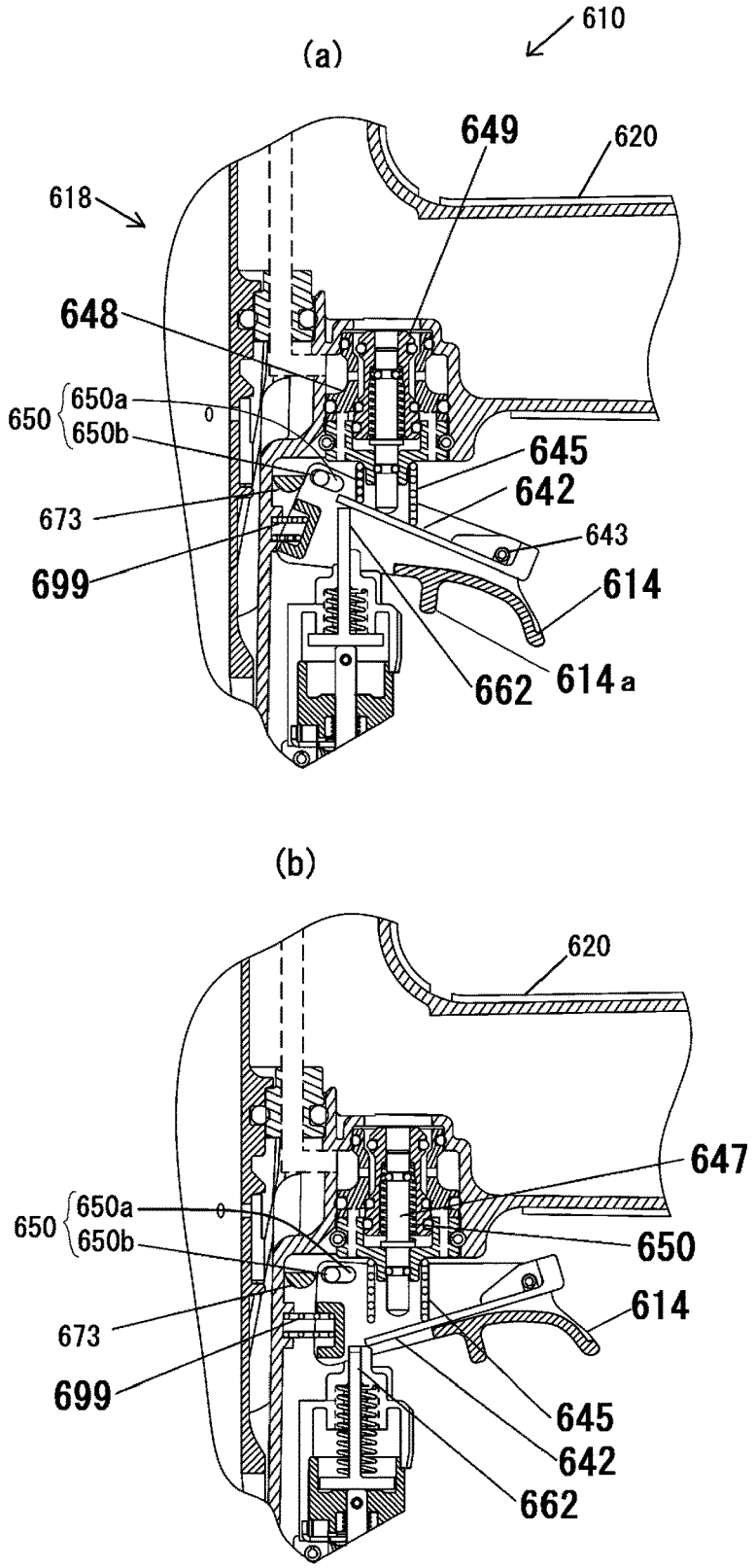
FIG. 30 is a partial cross-sectional view showing a fourth embodiment (first mode) of the driving tool.
Figure 31:
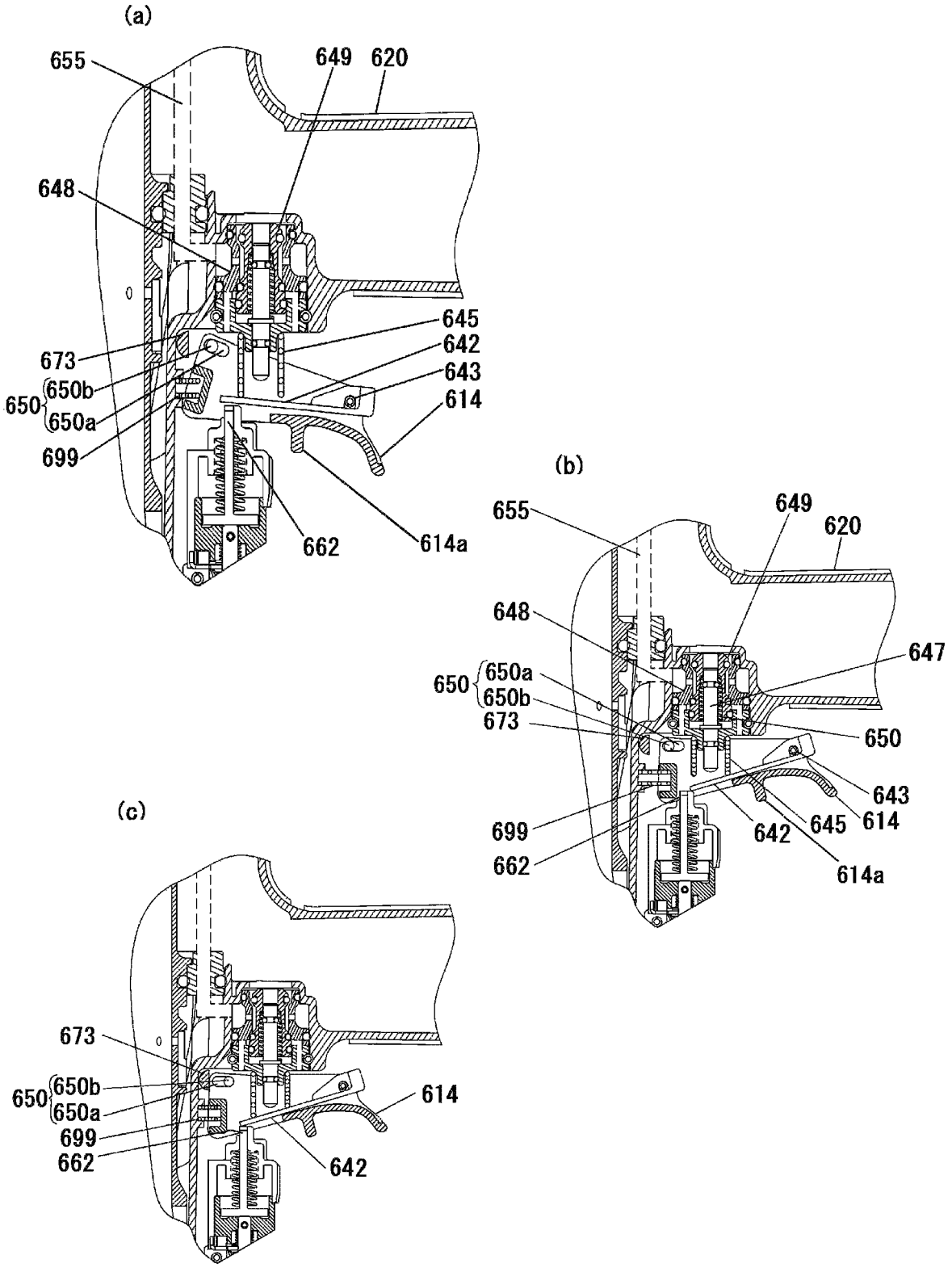
FIG. 31 is a partial cross-sectional view showing the fourth embodiment (second mode) of the driving tool.

(Fourth embodiment) FIGS. 30 and 31 are enlarged side view showing a fourth embodiment of a driving tool 610, which is a driving tool that operates using compressed air as a compressible gas, like the above-described first embodiment and the like, and the configuration not described in detail is the same as that of the above-described embodiments. For example, a plunger 647, a body 648, a valve body 649, a passage 655 is a structure corresponding to the plunger 47, the body 48, the valve body 49, the passage 55 of the first embodiment.

The driving tool 610 has a trigger 614 having a trigger sliding operation part 614*a*. Further, it has a handle 620 connected to a tubular body part 618, and a magazine (not shown) is attached to the driving tool 610. The trigger 614 rotatably holds a trigger arm 642 via a rotation shaft 643 at one end thereof, and the trigger arm 642 is urged in the downward direction in the drawing by a trigger release urging member 645.

Further, the trigger 614 has an elongated hole-shaped rotation hole 650*a* that is rotatable and slidable at an end part of the trigger arm on a side opposite to the rotation shaft 643, and the rotation hole 650*a* is combined with a rotation pin 650*b* that is engaged with the body part 618 or the like to form a rotation part 650. The rotation hole 650*a* extends in the longitudinal direction of the trigger 614. The trigger 614 is urged by a mode selection trigger urging member 699 to the right side of the drawing, that is, in the direction in which the body part 618 and the rotation shaft 643 of the trigger arm 642 separate from each other. Further, a mode selection member 673 is provided between the rotation shaft of the trigger 614 and the body part 618, and preferably, a semicircular member having a rotation shaft is provided so as to be able to contact the trigger 614 and the body part 618.

The mode selection member 673 has a first operating position corresponding to a first mode and a second operating position corresponding to a second mode. In the first mode, the operator applies an operating force to the trigger 614 in a state where a push lever (not shown) is in contact with a workpiece. Further, in the second mode, the push lever is brought into contact with the workpiece in a state where the operator has applied an operating force to the trigger 614.

The operator operates the mode selection member 673 to select the first mode or the second mode in a state where the operating force applied to the trigger 614 is released and the push lever separates from the workpiece. The mode selection member 673 has a configuration that can maintain the state in either the first mode or the second mode, as in the above-described second embodiment.

(Example of selecting the first mode) (a) and (b) of FIG. 30 show a case where the operator selects the first mode. As shown in (a) of FIG. 30, the mode selection member 673 has a configuration that restricts the trigger 614 in a direction away from the body part 618, and the rotation part 650 of the trigger 614 is fixed to the left side of the drawing. As a result, an end of the trigger arm 642 rotatably engaged with the rotation shaft 643 is provided at a position close to the pin 662 which extends from the push lever and which is slidably engaged.

Like the first embodiment or the second embodiment, in the first mode, in the trigger arm 642 and the pin 662, the end of the trigger arm 642 and the pin 662 contact each other when the push lever operates first. Then, when the operator applies an operating force to rotate the trigger 614, the operating force from the pin 662 is transmitted to the trigger arm 642, and the operating force from the push lever and the operating force of the trigger 614 cooperate to drive the trigger valve 46. On the contrary, when the operator operates the trigger 614 before the operation of the push lever, as shown in (b) of FIG. 30, the engagement between the end of the trigger arm 642 and the pin 662 is released, and the striking part is not operated.

(Example of selecting the second mode) When it is intended to select the second mode, as shown in (a) of FIG. 31, the mode selection member 673 rotates, whereby the restriction of sliding of the rotation shaft 643 of the trigger 614 is released, and the trigger 614 is urged to the right side of the drawing by the urging force of the mode selection trigger urging member 699. Then, as shown in (b) of FIG. 31, when the operator operates to rotate the trigger 614, it is rotated while the body part 618 and the rotation shaft 643 of the trigger arm 642 are urged in a direction of separating from each other, and the end of the trigger arm 642 and the pin 662 are disengaged. Therefore, even if the push lever is operated in the state of (b) of FIG. 31, since the engagement of the pin 662 and the trigger arm 642 is released, the striking part is not operated.

In addition, when the operator, from the state of (b) of FIG. 31, further operates the trigger sliding operation part 614*a* to slide the trigger 614 to the left direction in the drawing (that is, to move the trigger 614 against the urging force of the mode selection trigger urging member 699) to the state of (c) of FIG. 31 and then operates the push lever, the end of the trigger arm 642 is provided at a position in contact with the pin 662 which extends from the push lever, and each time the push lever is operated, the operating force from the push lever and the operating force of the trigger 614 cooperate to drive the trigger valve 46.

In the embodiment, the operation in the case of selecting the second mode is configured so that when the user performs a normal operation (rotating operation) of the trigger 614 and then performs an operation of sliding the trigger 614 again, the driving by the operation of the push lever is allowed, and the configuration in which the trigger sliding operation part 614*a* and the trigger 614 are slidable as well as rotatable forms the transmission control part of the disclosure, as in the above-described embodiments.

Figure 32:
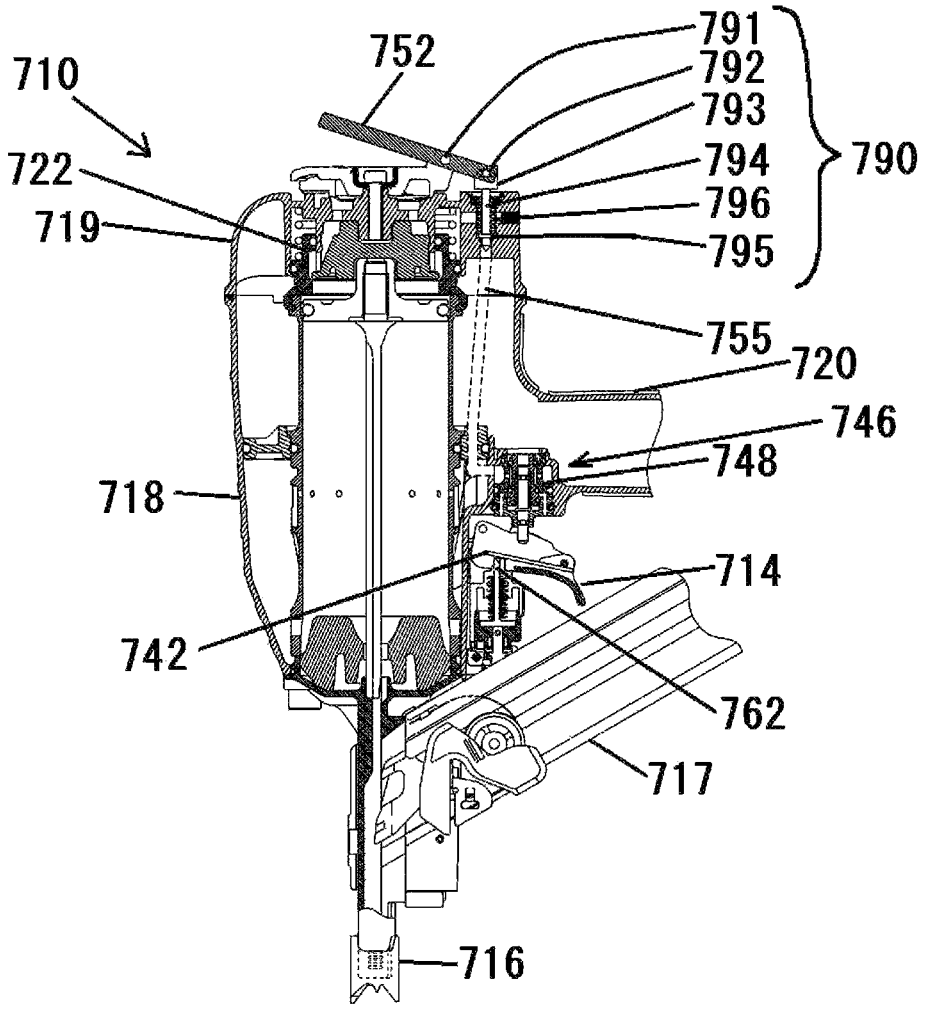
FIG. 32 is a cross-sectional view before operating the control lever in the fifth embodiment of the driving tool.
Figure 33:
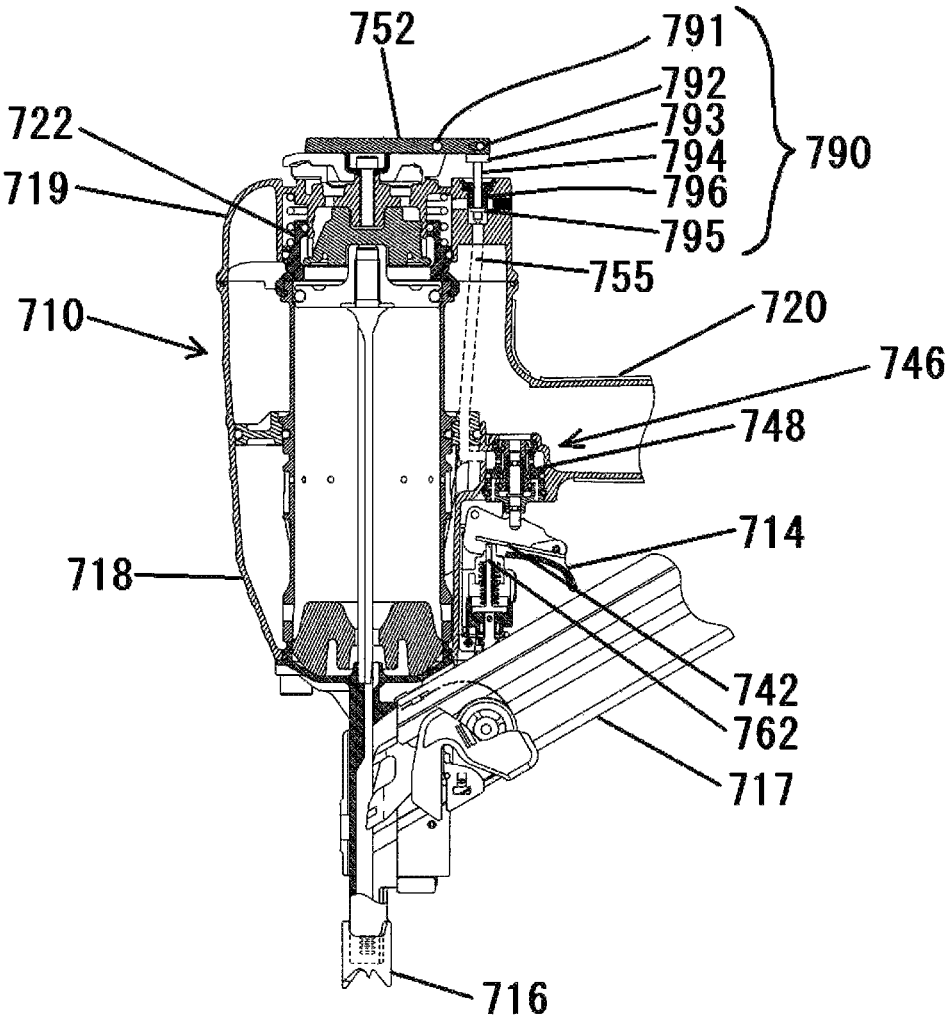
FIG. 33 is a cross-sectional view after operating the control lever in the fifth embodiment of the driving tool.

(Fifth embodiment) FIGS. 32 and 33 are cross-sectional views showing a fifth embodiment, and FIG. 32 shows a state before operating a transmission control part 790, and FIG. 33 shows a state after operating the transmission control part 790, which is a driving tool that operates using compressed air as a compressible gas, like the above-described first embodiment and the like, and the configuration not described in detail is the same as that of the above-described embodiments. For example, a body 748 is a structure corresponding to the body 48 of the first embodiment.

A driving tool 710 has a trigger 714. Further, it has a handle 720 connected to a tubular body part 718, and a magazine 717 is attached to the driving tool 710. The magazine 717 is exemplified, for example, as a magazine 717 that can be equipped with an angle type connecting fastener in which the connecting direction of the fastener is obliquely upward from the direction orthogonal to the ejection direction, but like other embodiments, a fastener configured to have the connecting direction orthogonal to the ejection direction and the magazine 717 may be used.

It is configured that the trigger 714 rotatably holds a trigger arm 742 via a rotation shaft at one end thereof, and that the trigger arm 742 is connectable to a pin 762 which extends from a push lever 716 at an end on a side opposite to the rotation shaft. Further, the trigger 714 can switch between a first mode and a second mode by a mode selection member (not shown). The meanings of the first mode and the second mode are as in other above-described embodiments.

For the mode selection member in the embodiment, a conventional configuration known as a single-shot mode or a continuous-shot mode can be applied. For example, by providing a mode selection member that is eccentric with respect to the rotation shaft of the trigger 714, in the first mode, the pin 762 is operated by the push lever 716, and the pin 762 and the trigger arm 742 engage only when the operator operates to rotate the trigger 714, and a trigger valve 746 is allowed to open or close. In addition, in the second mode, the pin 762 and the trigger arm 742 are always maintained in the engageable state, and when the operation of the push lever 716 and the rotating operation of the trigger 714 by the operator are satisfied as conditions regardless of the order, the trigger valve 746 is allowed to open or close.

In the embodiment, the transmission control part 790 having an opening/closing valve is provided in a control passage 755 that communicates the trigger valve 746 and a head valve 722. The transmission control part 790 is provided with a control lever 752; a cylinder shaft head 793 and a cylinder shaft 794 which are rotatably engaged by a lever rotation shaft 791 and a cylinder rotation shaft 792 rotated with respect to a head cover 719, and which are slidable with respect to the body part 718; a shielding valve 795 which controls the control passage 755 to open and close between the cylinder shaft and the head cover 719 or the body part 718; and a shielding valve urging member 796 which urges the shielding valve 795 in the shielding direction. Further, the cylinder shaft 794 has an O-ring or the like so that hermeticity is maintained between the cylinder shaft 794 and the head 793 exposed to the outside. Further, the control lever 752 is urged in the rotating direction toward the upper side of the drawing by the force of an urging member (not shown) or the shielding valve urging member 796.

The operator operates the mode selection member (not shown) to select the first mode or the second mode in a state where the operating force applied to the trigger 714 is released and the push lever separates from the workpiece. The mode selection member has a configuration that can maintain the state in either the first mode or the second mode, as in the above-described second embodiment.

When starting the work in either the first mode or the second mode, the operator operates the transmission control part 790, that is, performs the operation of rotating the control lever 752. In other words, it is necessary to open the shielding valve 795 and establish a state where the trigger valve 746 and the head valve 722 communicate with each other in the control passage 755.

(Example of selecting the first mode) When the operator operates the push lever to move the pin 762 in the upward direction in the drawing, the control lever 752 is rotated, and then the trigger 714 is rotated. For example, after the handle 720 is grasped with one hand and the push lever is pressed against the workpiece, the head cover 719 is held so that the tip of the push lever does not float or shift while the control lever 752 is pressed with the other hand, and then the trigger 714 is rotated. As a result, the trigger valve 746 and the head valve 722 are communicated with each other by the control passage 755, whereby the head valve 722 is driven by the force of the compressed air, and the striking operation of the fastener is performed.

(Example of selecting the second mode) The operator rotates the control lever 752 in a state of having operated the trigger 714, and then operates the push lever. For example, the handle 720 is grasped with one hand, and then the trigger 714 is rotated, and the other hand is used to press the head cover 719 toward the direction of the workpiece while pressing the control lever 752, whereby the push lever can be easily operated. As a result, the trigger valve 746 and the head valve 722 are communicated with each other by the control passage 755, whereby the head valve 722 is driven by the force of the compressed air, and the striking operation of the fastener is performed.

Examples of the technical meanings of the matters described in the above first to fifth embodiments are as follows. The driving tool 10 and the like are examples of a driving tool. The trigger 14 and the like are examples of an operating member, and the push lever 16 and the like are examples of a contacting member. The piston upper chamber 32 and the like are examples of a pressure chamber. The striking part 13 and the like are examples of a striking part. The head valve 22, the trigger valve 46, and the like are examples of a gas supply mechanism. The pin 62, the trigger arm 42, and the like are examples of a transmission member that transmits the operating force from the operating member or the contacting member.

The stopper 69 and the plunger 85 are examples of a restricting member. The control part 77, the electromagnets 70 and 70A, and the coil 84 are examples of a driving part. The electromagnets 70 and 70A and the coil 84 are magnetic force generating parts.

It is an example of the first state that the tip of the stopper 69 is located within the operating range of the engaging part 67. It is an example of the restricting control that the control part 77 supplies power to the electromagnets 70 and 70A to make the tip of the stopper 69 located within the operating range of the engagement part 67. It is an example of the first state that the tip 85A of the plunger 85 is located within the operating range of the pin 62. It is an example of the restricting control that the control part 77 controls the solenoid 83 to make the tip 85A of the plunger 85 located within the operating range of the pin 62.

It is an example of the second state that the tip of the stopper 69 is located outside the operating range of the engaging part 67. It is an example of the releasing control that the control part 77 stops the supply of power to the electromagnets 70 and 70A to make the tip of the stopper 69 located outside the operating range of the engagement part 67. It is an example of the second state that the tip 85A of the plunger 85 is located outside the operating range of the pin 62. It is an example of the releasing control that the control part 77 controls the solenoid 83 to make the tip 85A of the plunger 85 located outside the operating range of the pin 62. The main body 11 is an example of a housing. The support shaft 40 is an example of a support shaft. The support shaft 40 is an example of a first support shaft, and the support shaft 88 is an example of a second support shaft. The mode selection member 73 is an example of a mode selection member. The power switch 74 and the power supply 78 are examples of a power supply part. The nail 57 is an example of a fastener. The urging member 63 is an example of a buffer member. The trigger sensor 75 is an example of a signal output part.

When the trigger sensor 75 is on in the first state, the push lever 16 is pressed against the workpiece 81, and the trigger sensor 75 switches from on to off, and the signal output by the trigger sensor 75 is an example of a first signal. When the trigger 14 stops at the operating position and the trigger sensor 75 is on, the trigger 14 operates from the operating position toward the initial position, and the signal output when the trigger sensor 75 turns off is an example of a second signal. The trigger arm 42 is an example of an arm. The trigger arm 42 pressing the contactor 75A is an example of the arm acting on the signal output part.

The driving tool is not limited to the above embodiments, and various modifications can be made without departing from the spirit of the disclosure. For example, the operating member includes an element that is operated within a predetermined range by being applied with an operating force, in addition to elements that are rotated within a range of a predetermined angle by being applied with an operating force. The operating member includes a lever, a knob, a button, an arm and the like. The contacting member is an element that is pressed against a workpiece to operate, and includes a lever, an arm, a rod, a plunger, and the like.

The control part may be a single electric component or electronic component, or may be a unit having multiple electric components or multiple electronic components. The electric or electronic component includes a processor, a control circuit and a module. The gas supply mechanism includes a switching valve that switches connection between the passages and disconnection between the passages.

The housing is an element that supports a component element of the driving tool or a member connected to this element, and the housing includes a case, a bracket, and a shell. An inert gas such as nitrogen gas or a rare gas may be used as the compressible gas instead of the compressed air. It is also possible to define the first mode as a single-shot mode and the second mode as a continuous-shot mode.

The trigger sensor 75 outputs a signal according to the state of the trigger 14. The state of the trigger 14 is the presence or absence of the operating force applied to the trigger 14, the operating angle of the trigger 14 with respect to the initial position, and the like. The push lever sensor 76 outputs a signal according to the state of the cylinder 61 that is operated by the operating force of the push lever 16 being transmitted. The state of the cylinder 61 is the presence or absence of the operating force transmitted to the cylinder 61, the operating amount of the cylinder 61 with respect to the initial position, and the like. A contact sensor or a non-contact sensor can be used as the trigger sensor 75 and the push lever sensor 76. An example of the contact sensor is a tactile switch. Examples of the non-contact sensor are optical sensors, magnetic sensors, and infrared sensors. The signals from the trigger sensor 75 and the push lever sensor 76 are input to the control part 77.

When the push lever sensor 76 can detect the operating amount of the cylinder 61, in step S5 of FIG. 9, the control part 77 can stop the supply of power to the electromagnets 70 and 70A at the time when the cylinder 61 operates from the initial position toward the operating position by a predetermined amount. The predetermined amount is a value at which the stopper 69 does not block the operation of the pin 62 when the supply of the current to the electromagnets 70 and 70A stops. Data of the predetermined amount is a value obtained by performing simulation and experiment, and is stored in the control part 77 in advance.

Further, it is also possible to provide the permanent magnet 72 on the push lever 16 and the electromagnet 70 on the stopper 69 as a modified example of the restricting mechanism 68 shown in FIG. 4. It is also possible to provide the permanent magnet 72 on the push lever 16 and the electromagnet 70A on the stopper 69 as a modified example of the restricting mechanism 68 shown in FIG. 11. The trigger arm may be any element that is operable and stoppable to come into contact with or separate from the signal output part to cause the signal output part to output a signal. That is, it is not limited to what is called a trigger arm, and a lever may also be used.

Further, when the operation of the transmission control part is performed by a hand different from the hand performing the rotating operation of the trigger as illustrated in the second and subsequent embodiments, the driving operation is performed with the driving tool being sufficiently held. As a result, the fastener can be driven into the intended position of the workpiece. Furthermore, insufficient driving (nail floating) and the like are reduced, and work with better completion can be realized. Further, in the case of having the first mode and the second mode, in the second mode, when the push lever is operated, since the driving work is performed using the force of both hands, and since the burden on one hand of the operator is reduced, the workability is improved.

What is claimed is:

1. A driving tool comprising:

an operating member to which an operator applies an operating force;

a housing including a support shaft that operably supports the operating member;

a contacting member which is capable of contacting and separating from a workpiece into which a fastener is to be driven, and which operates by coming into contact with the workpiece;

a pressure chamber to which and from which a compressible gas is supplied and discharged;

a striking part which operates in a direction to strike the fastener when the compressible gas is supplied to the pressure chamber;

a gas supply mechanism which supplies the compressible gas to the pressure chamber; and a transmission control member which operates independently of the operating member and the contacting member and to which the operator applies an operating force, wherein the striking part strikes the fastener when an operating force of the operator is applied to the operating member and another operating force of the operator is applied the transmission control member and when the contacting member is operated, wherein the transmission control member is movable within and outside an operating range of the operating member or the contacting member, and has a first state of being located within the operating range of the operating member or the contacting member and a second state of being located outside the operating range of the operating member or the contacting member when an operating force on the operating member is released.

2. The driving tool according to claim 1, further comprising:

a driving part which is capable of switching a state of the transmission control member between the first state and the second state when an operating force is applied to the operating member; and a switch which controls the driving part, wherein the driving part performs a releasing control which sets the transmission control member to the second state when an operating force is applied to the operating member and an operating force is applied to the switch, and a restricting control which sets the transmission control member to the first state when the operating force of the switch is released.

3. The driving tool according to claim 2, wherein at least one of the transmission control member and the driving part includes a magnetic force generating part which generates a magnetic force when power is supplied, the driving part switches the state of the transmission control member between the first state and the second state by controlling supply of the power and stop of the power to the magnetic force generating part, the support shaft operably supports the operating member and operably supports the transmission control member, a first support shaft which rotatably supports the operating member and a second support shaft which operably supports the transmission control member are separately provided, and the releasing control is to set the transmission control member to the second state from a time point when an operating force is applied to the operating member.

4. The driving tool according to claim 1, wherein the transmission control member has:

a transmission control operating member which is graspable by the operator; and a transmission control sliding part which is capable of switching between the first state and the second state.

5. The driving tool according to claim 1, further comprising:

a mode selection member, wherein the mode selection member has:

a first mode in which an operating force is applied to the operating member in a state where the contacting member is in contact with the workpiece; and a second mode in which the contacting member is brought into contact with the workpiece in a state where an operating force is applied to the operating member.

6. The driving tool according to claim 5, further comprising:

a power supply part which performs supply and stop of power to the driving part, wherein the driving part is activated when the power is supplied, and the power supply part stops the supply of the power to a driving part when the operator operates the mode selection member to select the first mode, and supplies the power to the driving part when the operator operates the mode selection member to select the second mode.

7. The driving tool according to claim 5, wherein the mode selection member has a mode switching urging member, the second mode is maintained when the operator is operating the mode selection member, and the first mode is maintained by the mode switching urging member releasing the second mode when the operator discontinues the operation of the mode selection member.

8. The driving tool according to claim 7, further comprising:

a first grip part which is graspable by the operator with one hand and which is capable of operating the operating member; and a second grip part which is graspable by the operator with the other hand and which is capable of applying an operating force on the mode selection member.

9. The driving tool according to claim 7, further comprising:

a pivot support part provided in the housing;

a mode switching operating member rotatable via the pivot support part; and a linear member which connects the mode selection member and the mode switching operating member, wherein the second mode is maintained when the mode switching operating member is operated by the operator.

10. The driving tool according to claim 5, further comprising:

a bearing part which slidably supports the support shaft in a first direction that intersects the direction to strike the fastener and in a second direction that is opposite to the first direction, and which rotatably supports the operating member; and a sliding operation part which allows a support shaft urging member which applies an urging force to the support shaft in the first direction and the operating member to slide in the second direction, wherein in the first mode, the operating member performs an operation of striking the fastener by a rotating operation of the operator at an end part of the bearing part in the first direction, and in the second mode, the operating member performs an operation of striking the fastener when the operator performs both an operation of moving the bearing part to an end part in the second direction and the rotating operation.

11. The driving tool according to claim 1, wherein the transmission control member has a control valve part which controls supply and discharge of the compressible gas to and from the pressure chamber.

12. A driving tool comprising:

an operating member to which an operator applies an operating force;

a housing including a support shaft that operably supports the operating member;

a contacting member which is capable of contacting and separating from a workpiece into which a fastener is to be driven, and which operates by coming into contact with the workpiece;

a pressure chamber to which and from which a compressible gas is supplied and discharged;

a striking part which operates in a direction to strike the fastener when the compressible gas is supplied to the pressure chamber;

a gas supply mechanism which supplies the compressible gas to the pressure chamber;

a transmission control member which operates independently of the operating member and the contacting member and to which the operator applies an operating force, wherein the striking part strikes the fastener when an operating force of the operator is applied to the operating member and another operating force of the operator is applied the transmission control member and when the contacting member is operated;

a mode selection member which is capable of switching between a first mode and a second mode;

a bearing part which slidably supports the support shaft in a first direction that intersects the direction to strike the fastener and in a second direction that is opposite to the first direction, and which rotatably supports the operating member; and a sliding operation part which allows a support shaft urging member which applies an urging force to the support shaft in the first direction and the operating member to slide in the second direction, wherein in the first mode, the operating member performs an operation of striking the fastener by a rotating operation of the operator at an end part of the bearing part in the first direction, and in the second mode, the operating member performs an operation of striking the fastener when the operator performs both an operation of moving the bearing part to an end part in the second direction and the rotating operation.

* * * * *